US007300135B2

(12) United States Patent
Takagi

(10) Patent No.: US 7,300,135 B2
(45) Date of Patent: Nov. 27, 2007

(54) INK JET RECORDING APPARATUS AND MAINTENANCE MECHANISM THEREFOR

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 338 days.

(21) Appl. No.: 11/065,648

(22) Filed: Feb. 25, 2005

(65) Prior Publication Data

US 2005/0190228 A1 Sep. 1, 2005

(30) Foreign Application Priority Data

Feb. 27, 2004 (JP) ..... 2004-054809
Feb. 27, 2004 (JP) ..... 2004-054906

(51) Int. Cl.
*B41J 2/165* (2006.01)

(52) U.S. Cl. ..... 347/35; 347/29; 347/30; 347/32; 347/33

(58) Field of Classification Search ..... 347/22–35
See application file for complete search history.

(56) References Cited

U.S. PATENT DOCUMENTS

2002/0044168 A1 4/2002 Hashi et al.

FOREIGN PATENT DOCUMENTS

| | | |
|---|---|---|
| JP | A 09-123470 | 5/1997 |
| JP | A 09-239999 | 9/1997 |
| JP | A 2000-103086 | 4/2000 |
| JP | A 2000-168062 | 6/2000 |
| JP | A 2000-211159 | 8/2000 |
| JP | A 2002-355991 | 12/2002 |
| JP | A 2003-182102 | 7/2003 |

*Primary Examiner*—Shih-Wen Hsieh
(74) *Attorney, Agent, or Firm*—Oliff & Berridge, PLC

(57) ABSTRACT

A maintenance mechanism includes: a carriage 22 capable of performing reciprocating movement along a line parallel to an ink discharging surface 4*a;* and a purge sheet 21 attached to the carriage 22 and capable of being located, depending on the carriage 22 position, in a purge position opposing the ink discharging surface 4*a* and a printing position not opposing the ink discharging surface 4*a*. When being in the purge position, the purge sheet 21 has such a shape that allows ink discharged from the ink discharging surface 4*a* and adhered to the purge sheet. 21 to move, owing to gravity, toward the center of the purge sheet 21 with respect to the width direction of the purge sheet 21 which is perpendicular to the traveling direction of the carriage 22.

38 Claims, 15 Drawing Sheets

INK JET RECORDING APPARATUS AND MAINTENANCE MECHANISM THEREFOR

BACKGROUND OF THE INVENTION

1. Field of the Invention

The present invention relates to an ink jet recording apparatus for discharging ink onto a print medium so as to perform printing.

2. Description of the Related Art

In ink jet heads provided in ink jet printers so as to discharge ink, such a type is known that includes: a plurality of nozzles for discharging ink; a plurality of pressure chambers in fluid communication with each nozzle; and a plurality of actuators arranged in correspondence to each pressure chamber. When each actuator is driven, the volume of a pressure chamber corresponding to the actuator decreases so that ink corresponding to the decreased volume is discharged from the nozzle. In such an ink jet head, ink having high viscosity can stick to the inside of the nozzle. Alternatively, impurities or bubbles having flowed from the ink tank can mix in. When such a situation occurs, the ink discharging characteristics are disturbed so that a good printing result is not obtained. Accordingly, a purge operation is performed in which a large amount of ink is periodically discharged from all the nozzles so as to purge high viscosity ink, impurities, and bubbles present in the nozzle.

Furthermore, in a known technique for collecting the ink discharged in the purge operation, a sheet (maintenance sheet) is provided that has flexibility and ink absorbency (JP-A-2000-168062). In this technique, the sheet is arranged in a position opposing the ink discharging surface, and then a purge operation is performed. The ink discharged in the purge operation is absorbed and retained in the sheet. This ensures the discharged ink to be collected without leakage. Furthermore, the sheet is flexible, and hence can be accommodated in a rolled-up state. This permits space reduction to a certain extent in comparison with the use of a cap.

SUMMARY OF THE INVENTION

In the technique described above, when the sheet absorbs a predetermined amount of ink, the sheet needs to be changed. This increases the running cost of the printing. Thus, in an alternative technique, the discharged ink may be received by a sheet having no ink absorbency, and then the received ink may be guided and collected into a disposed ink tank prepared separately. Nevertheless, the sheet is arranged in a space between an ink discharging surface and a sheet conveyance mechanism, and hence the sheet cannot sufficiently be inclined steeply. Thus, the received ink cannot flow freely toward the disposed ink tank, and easily stagnates on the sheet. This causes a problem that when the sheet is collected, the stagnated ink spills out and blots the sheet conveyance mechanism.

One of objects of the invention is to provide an ink jet recording apparatus in which ink discharged in a purge operation is collected without being stagnated on a sheet for receiving ink discharged in a purge operation.

According to a first aspect of the invention, there is provided a maintenance mechanism for an ink jet recording apparatus having an ink jet head, the maintenance mechanism including: a carriage that performs reciprocating movement along a line parallel to an ink discharging surface of the ink jet head; and a purge sheet attached to the carriage and arranged to be in either of an ink acceptance position and a recording permission position depending on a position of the carriage, the ink acceptance position in which at least a part of the purge sheet is disposed under the ink jet head and opposes the ink discharging surface, and the recording permission position in which an entirety of the purge sheet is removed from the ink discharging surface, wherein being in the ink acceptance position, the purge sheet is formed of a shape that allows ink discharged from the ink jet head and adhered to the purge sheet to move, owing to gravity, toward a center of the purge sheet with respect to a sheet width direction perpendicular to a traveling direction of the carriage, the traveling direction in which the carriage performs the reciprocating movement.

According to a second aspect of the invention, there is provided an ink jet recording apparatus including: an ink jet head provided with an ink discharging surface in which a plurality of nozzles for discharging ink onto a print medium are formed; a carriage that performs reciprocating movement along a line parallel to the ink discharging surface; a purge sheet attached to the carriage and arranged to be in either of an ink acceptance position and a recording permission position depending on a position of the carriage, the ink acceptance position in which at least a part of the purge sheet is disposed under the ink jet head and opposes the ink discharging surface, and the recording permission position in which an entirety of the purge sheet is removed from the ink discharging surface, a carriage controller that controls the carriage to perform the reciprocating movement for moving the purge sheet between the ink acceptance position and the recording permission position; a discharge controller that controls the ink jet head for discharging the ink; and a deformation mechanism that deforms, when the purge sheet is in the ink acceptance position, the purge sheet into a shape that allows ink discharged from the ink jet head and adhered to the purge sheet to move, owing to gravity, toward a center of the purge sheet with respect to a sheet width direction perpendicular to a traveling direction of the carriage, the traveling direction in which the carriage performs the reciprocating movement, wherein the discharge controller controls the ink jet head to discharge ink in a state where the purge sheet is in the ink acceptance position.

According to a third aspect of the invention, there is provided an ink jet recording apparatus including: an ink jet head provided with an ink discharging surface in which a plurality of nozzles for discharging ink onto a print medium are formed; a conveyance mechanism that conveys the print medium and provided below the ink jet head; a purge sheet that accepts ink discharged from the ink discharging surface; a sheet accommodating unit provided below the print medium conveyance mechanism and accommodates the purge sheet; a carriage to which an edge portion of the sheet is attached and travels a space between the ink jet head and the print medium conveyance mechanism in a traveling direction crossing from one side toward another side to draw out the purge sheet from a recording permission position into an ink acceptance position, the ink acceptance position in which at least a part of the purge sheet is disposed under the ink jet head and opposes the ink discharging surface, and the recording permission position in which an entirety of the purge sheet is removed from the ink discharging surface; a sheet abutting member provided in the one side and abuts against the purge sheet; and a displacing unit that positions the sheet abutting member into a first position for imparting a predetermined tension to the purge sheet when the carriage is positioned on the other side across the space, and positions the sheet abutting member into a second position below the first position when the carriage is positioned on the one side.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

First Embodiment

Figure 1:
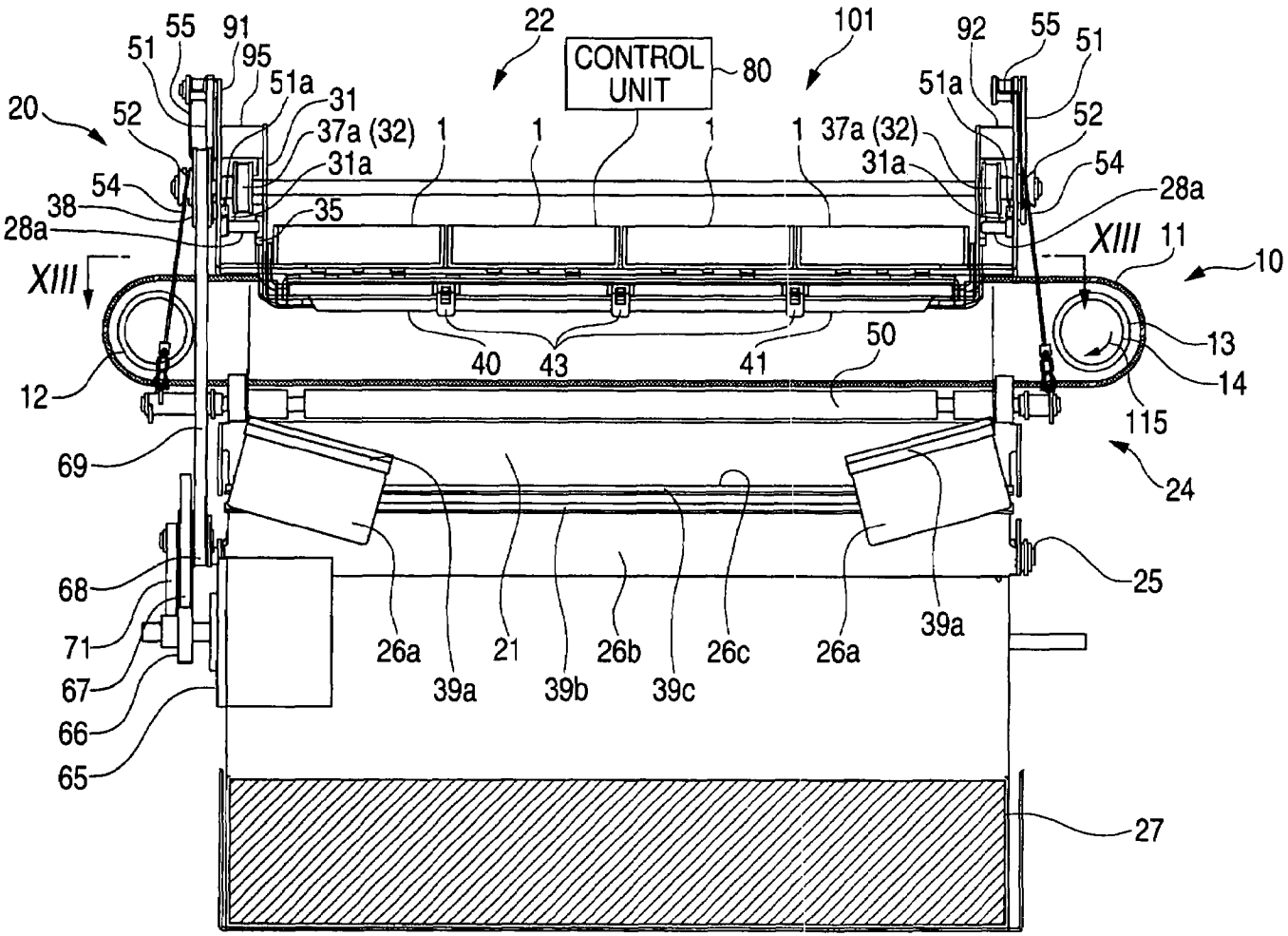
FIG. 1 is a schematic diagram of an ink jet printer according to a first embodiment.

FIG. 1 is a schematic diagram of an ink jet printer according to a first embodiment. An ink jet printer 101 includes: four ink jet heads 1; a sheet conveyance mechanism (print medium conveyance mechanism) 10 for conveying a sheet (print medium); a maintenance mechanism 20 for performing the maintenance of the ink jet heads 1; a control unit 80 for controlling the operation of the ink jet printer 101; and a main frame 91 for supporting these.

In the sheet conveyance mechanism 10, a conveyance path for sheet is formed such that a sheet fed from the right in the figure (referred to as a "sheet feed side" hereinafter) is ejected to the left in the figure (referred to as a "sheet ejection side" hereinafter). The sheet conveyance mechanism 10 includes: a sheet conveyance belt 11 running such that a conveyance surface travels along the conveyance path; two sheet belt rollers 12 and 13 for causing the sheet conveyance belt 11 to run; and a sheet belt drive motor 14 for driving the sheet belt roller 13. The sheet conveyance belt 11 is a ring shaped belt wound around so as to link the two sheet belt rollers 12 and 13. The outer peripheral surface, that is, the conveyance surface, of the sheet conveyance belt 11 is siliconized so that a sheet is retained on the conveyance surface of the sheet conveyance belt 11 by virtue of its adhesion property. Then, the sheet is conveyed from the sheet feed side toward the ejection side when the sheet belt roller 13 revolves clockwise in the figure (in the direction indicated by an arrow 115).

Figure 2:
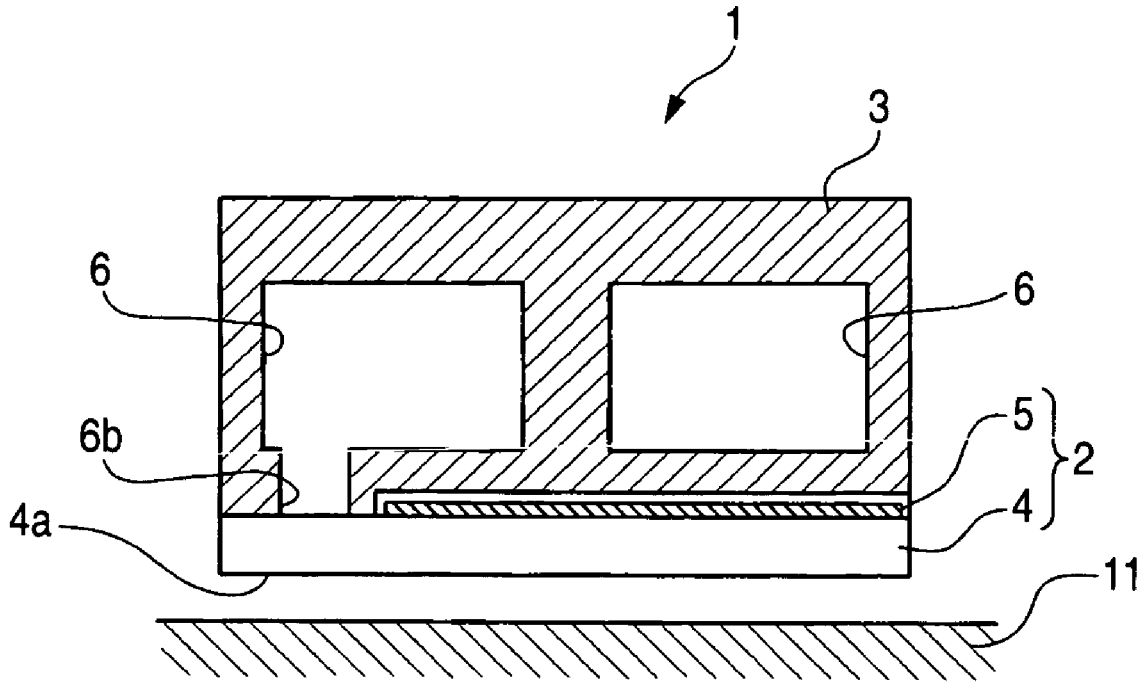
FIG. 2 is a sectional view of an ink jet head shown in FIG. 1 taken along a transverse direction.
Figure 3:
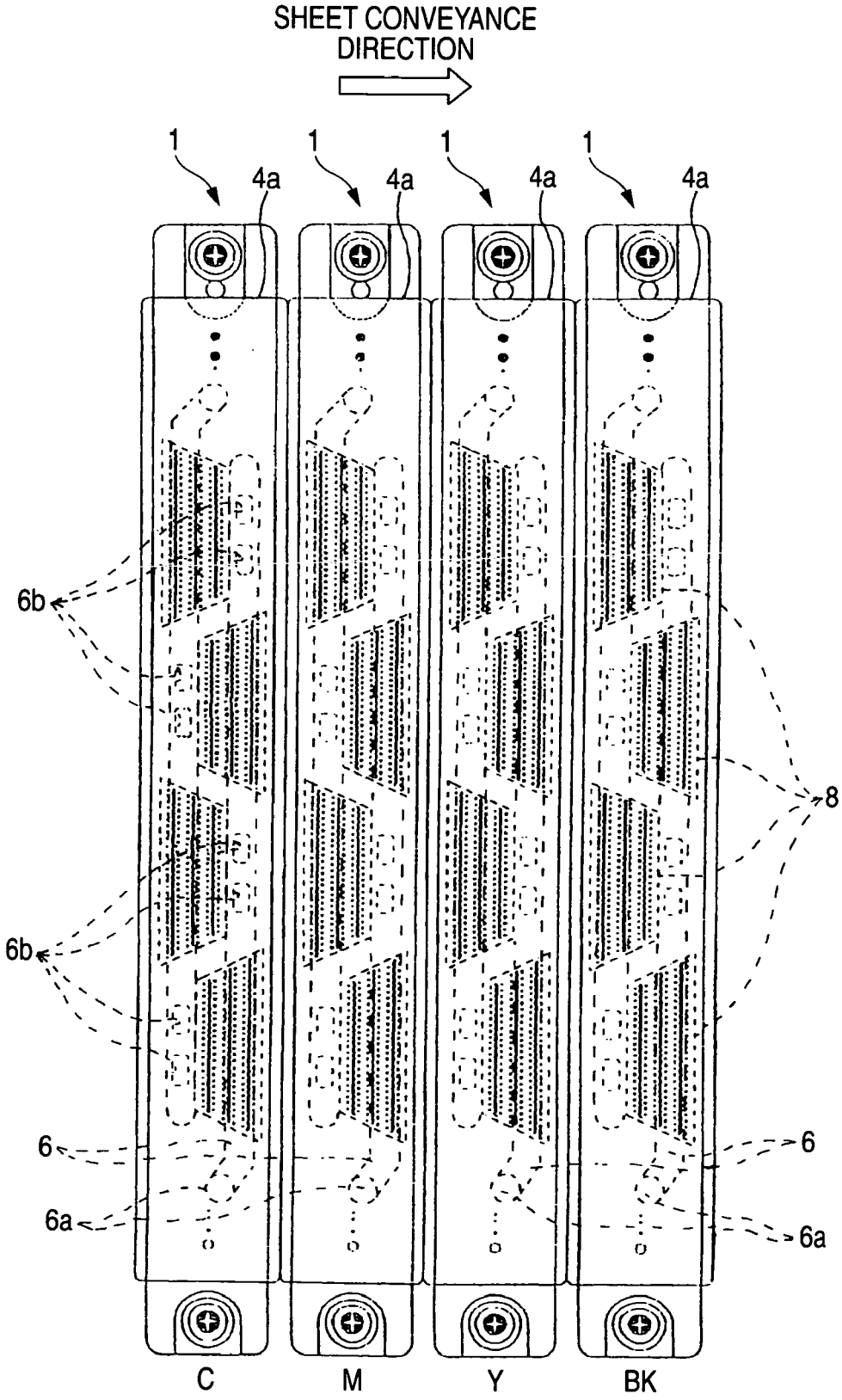
FIG. 3 is an external view of an ink discharging surface of an ink jet head shown in FIG. 1.

The ink jet head 1 is described below with reference to FIG. 2 and FIG. 3. FIG. 2 is a sectional view of the ink jet head 1 taken in the transverse direction. FIG. 3 is an external view of an ink discharging surface of the ink jet head 1. The ink jet head 1 has approximately the shape of a rectangular parallelepiped, and is arranged such that its longitudinal direction aligns with the width direction of the sheet conveyance belt 11. Furthermore, four ink jet heads are arranged along the longitudinal direction of the sheet conveyance belt. As shown in FIG. 2, each ink jet head 1 includes a block 3 and a head body 2. The head body 2 is arranged in a position opposing the conveyance surface of the sheet conveyance belt 11. The block 3 is connected on a side opposite the side of the head body 2 opposing the conveyance surface. As shown in FIG. 3, inside the block 3, two ink supply passages 6 each formed along the longitudinal direction of the block 3 are arranged along the transverse direction of the block 3. Each ink supply passage 6 includes: an ink inflow passage 6*a* to which ink is supplied through an opening formed on a side opposite the side connected to the head body 2; and an ink outflow passage 6*b* from which the ink in the ink supply passage 6 is supplied into the head body 2 through an opening formed in a position connected to the head body 2.

The head body 2 has such a stacked structure that a passage unit 4 and an actuator unit 5 are stacked in a direction perpendicular to the conveyance surface of the sheet conveyance belt 11. The passage unit 4 includes an ink discharging surface 4*a* in which a large number of nozzles 8 are formed on the surface opposing the conveyance surface of the sheet conveyance belt 11. Inside the passage unit 4, a plurality of ink passages are formed each including a nozzle 8 and a pressure chamber for causing ink to be discharged from the nozzle 8. The actuator unit 5 includes a plurality of actuators for reducing the volume of each pressure chamber of the passage unit 4. The actuator unit 5 is arranged in a gap formed between the block 3 and the passage unit 4, such that each actuator opposes each pressure chamber. When the control unit 80 drives each actuator, the volume of a pressure chamber corresponding to the actuator decreases so that ink corresponding to the decreased volume is discharged from the nozzle 8.

Figure 4:
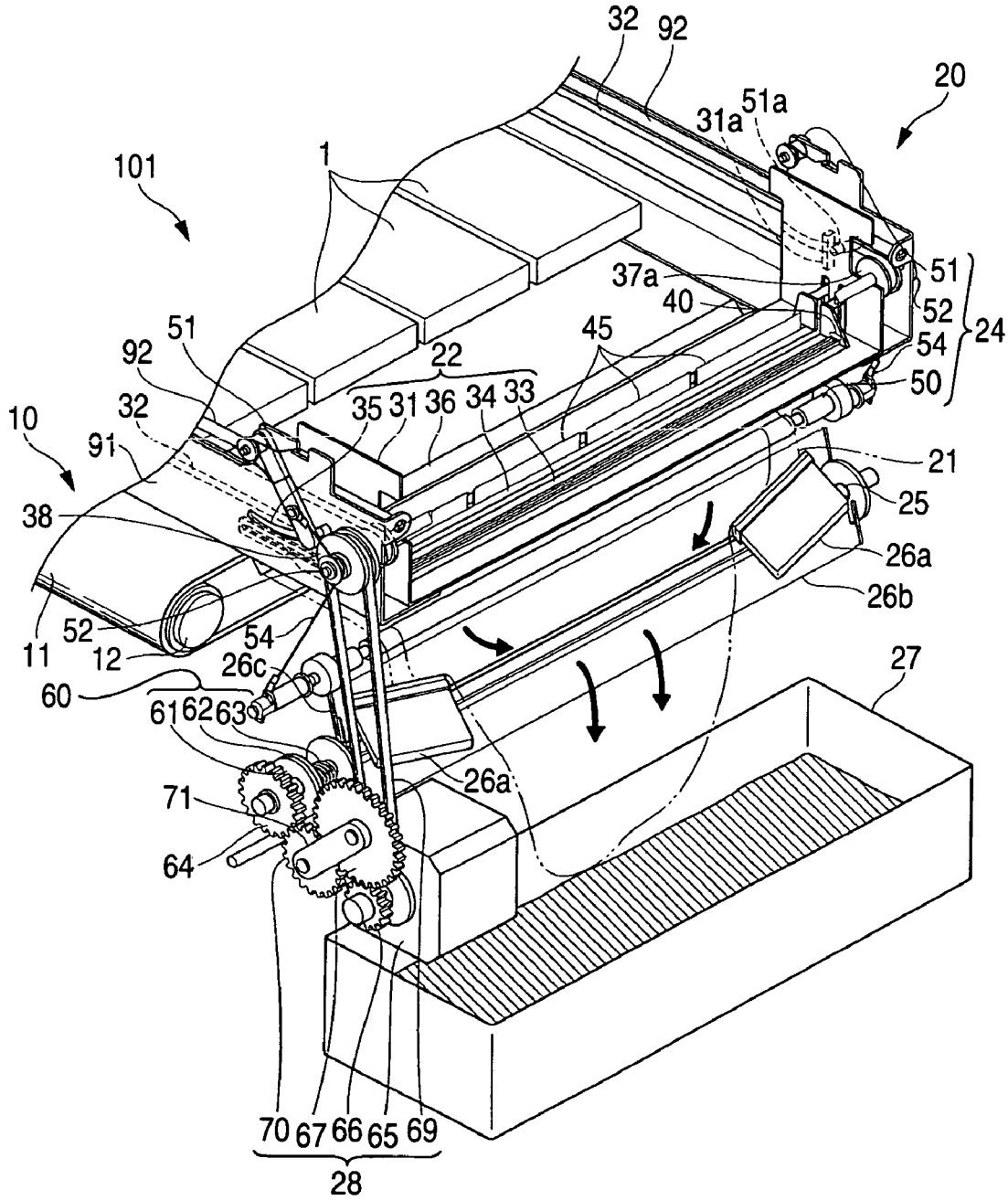
FIG. 4 is a perspective view of a maintenance mechanism shown in FIG. 1.

Next, the maintenance mechanism 20 is described below with reference to FIG. 4. FIG. 4 is a perspective view of the maintenance mechanism 20. Arrows in the figure indicate the flow of ink. The maintenance mechanism 20 serves to collect the ink discharged in a purge operation in which ink is discharged from all the nozzles 8 so as to purge impurities and high viscosity ink in the ink passages. As shown in FIG. 4, the maintenance mechanism 20 is arranged on the right-hand side in the longitudinal direction of the ink jet head 1 (referred to as the "main body right side" hereinafter) when viewed from the downstream of the conveyance direction of the sheet (referred to as the "main body rear side" hereinafter, while the opposite of the main body rear side is referred to as the "main body front side"). The maintenance mechanism includes a purge sheet 21, a carriage 22, a tension unit 24, a sheet roll-up shaft 25, ink guiding blades

26*a*, an ink scraping blade 26*b*, a cleaning blade 26*c*, a disposed ink tank 27, and a maintenance drive mechanism 28.

The purge sheet 21 is a flexible sheet having an elongated shape, and possesses an internal stress such that both edges in the width direction bend toward one side so that the cross section becomes concave in the width direction (the concave surface is referred to as the "sheet front surface" hereinafter, while the convex surface as the "sheet back surface"). Water repellent finishing is applied to the sheet front surface and the sheet back surface of the purge sheet 21. One edge portion of the longitudinal direction of the purge sheet 21 is fixed to the carriage 22, while another edge portion is fixed to the sheet roll-up shaft 25. Then, in normal printing, the purge sheet 21 is located (accommodated) in a position (recording permission position) that the purge sheet is rolled up around the sheet roll-up shaft 25 as described later. When the purge sheet 21 is located in the recording permission position (printing position, hereinafter), recording is permitted on the sheet. In a purge operation, the purge sheet 21 is located in a position (ink acceptance position) that the sheet front surface opposes the ink discharging surface 4*a* of the head body 2. When the purge sheet 21 is located in the ink acceptance position (purge position, hereinafter), the purge sheet opposes the ink discharging surface 4*a* of the ink jet head 1.

Figure 5:
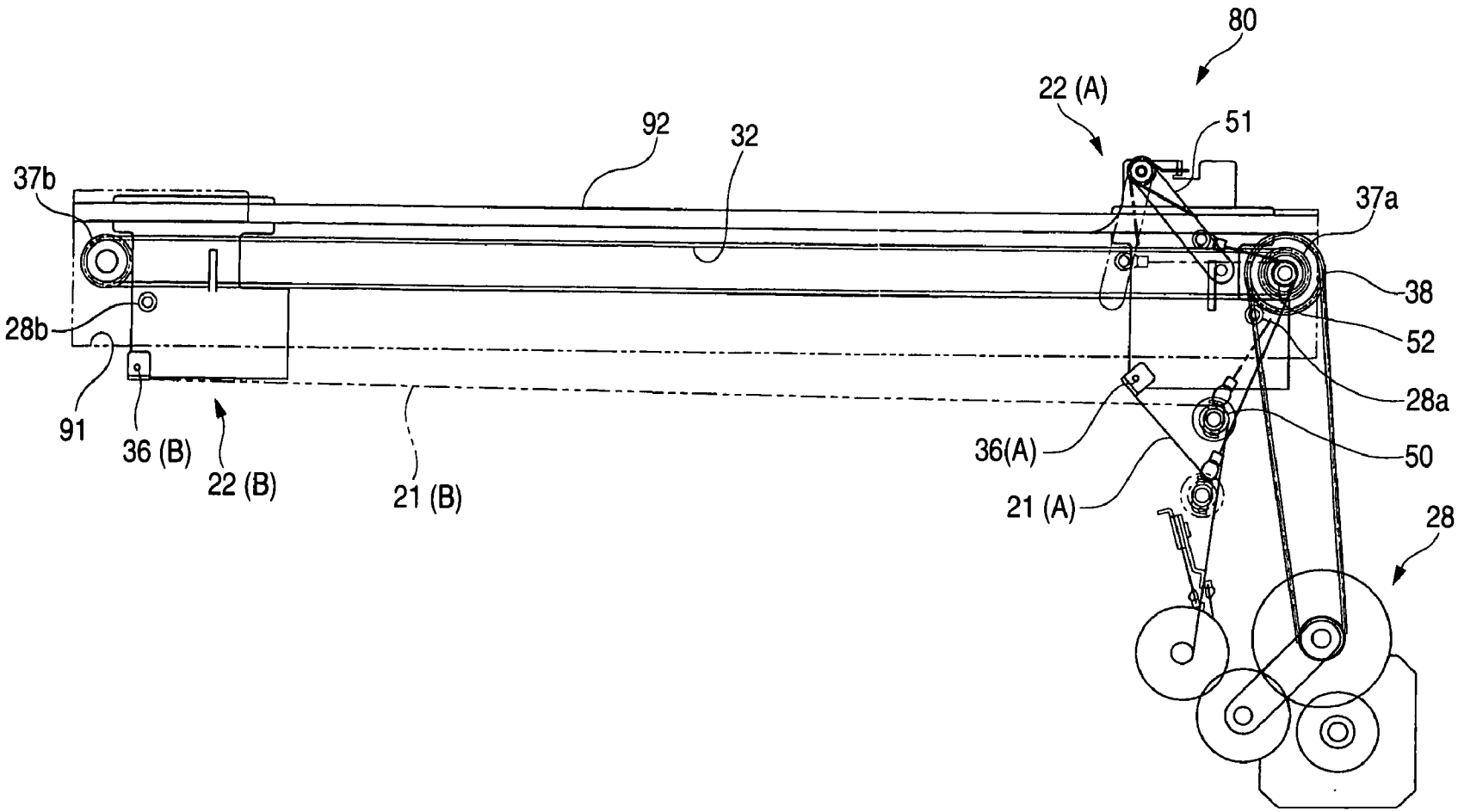
FIG. 5 is an external view of a maintenance mechanism shown in FIG. 1 viewed from the upstream of a conveyance direction for a sheet.
Figure 6B:
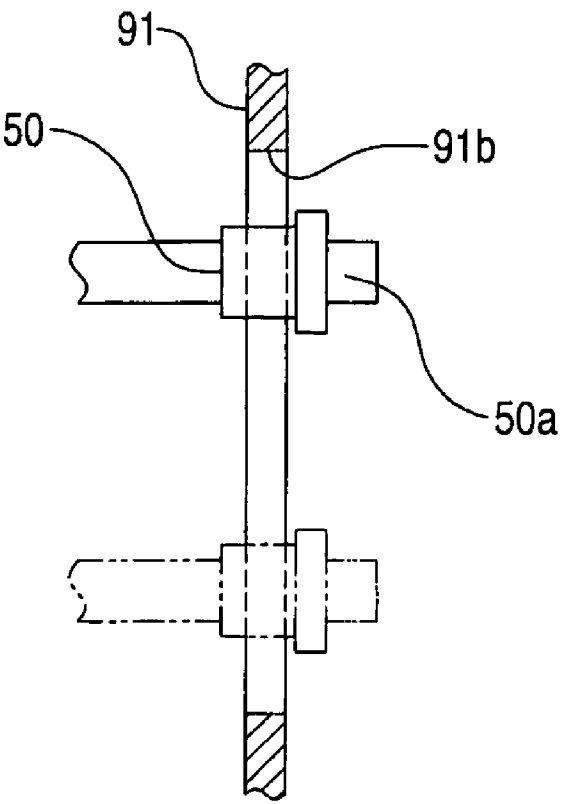
FIGS. 6A and 6B are views of a guide mechanism for a tension roller shown in FIG. 5.
Figure 6A:
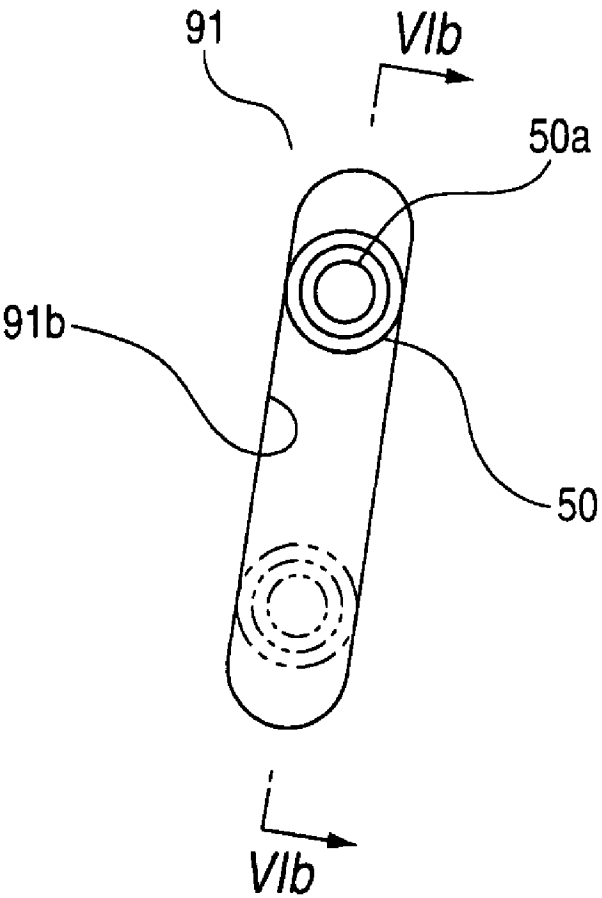
Figure 7B:
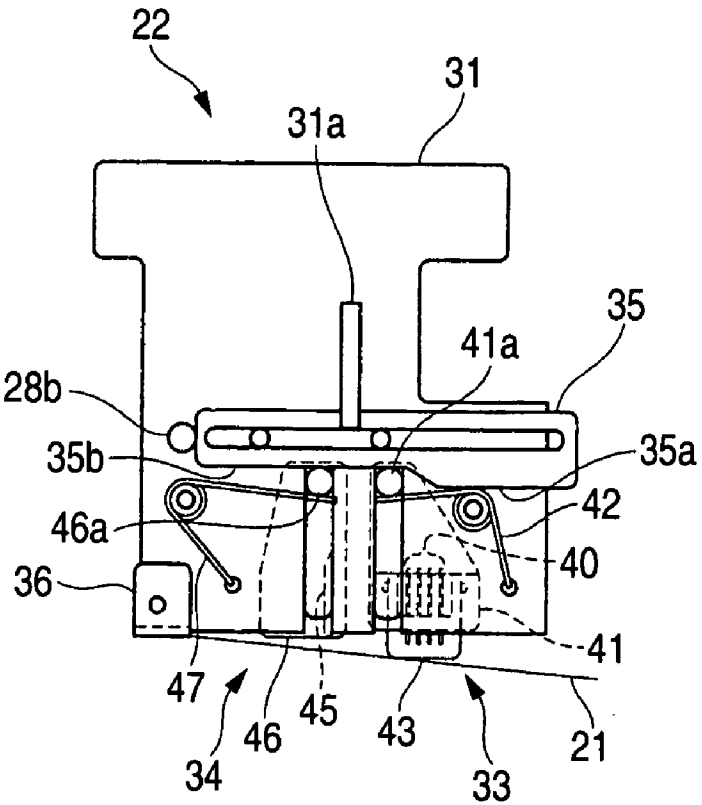
FIGS. 7A and 7B are enlarged views of a carriage shown in FIG. 5.
Figure 7A:
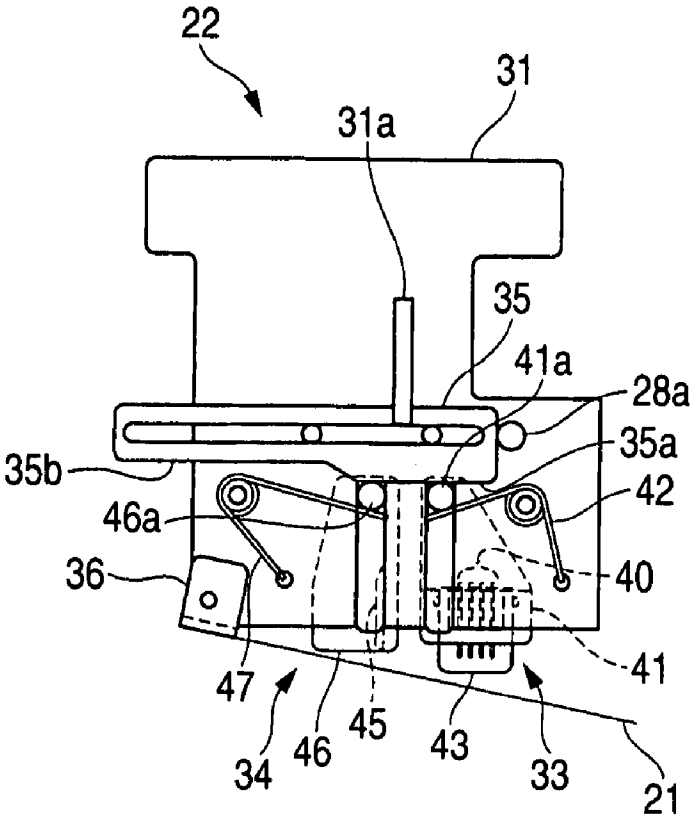
Figure 8:
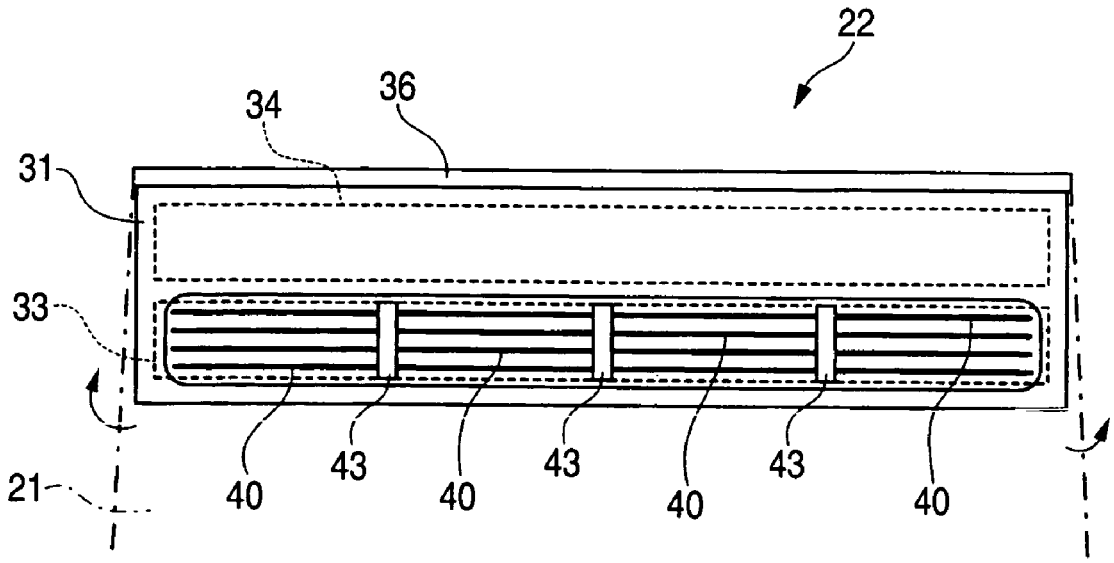
FIG. 8 is a view of a carriage shown in FIG. 1 viewed from a conveyance surface of a conveyance belt.

Next, the carriage 22 is described below with further reference to FIGS. 5, 6A, 6B, 7A, 7B and 8. FIG. 5 is an external view of the maintenance mechanism 20 viewed from the main body rear side. In the figure, the main frame is shown as if transparent for simplicity of description. FIGS. 6A and 6B are diagrams showing a guide mechanism of the tension roller 50 of FIG. 5. FIG. 6A is an enlarged view of the guide mechanism. FIG. 6B is a sectional view taken along line VIb-VIb in FIG. 6A. FIGS. 7A and 7B are enlarged views of the carriage 22 of FIG. 5. FIG. 8 is a view of the bottom surface of the carriage 22 viewed from the direction of the conveyance surface of the conveyance belt. As shown in FIG. 5, the carriage 22 reciprocates (travels) along two guide bars 92 extending on the main body front side and the main body rear side in the vicinity of the upper end of the main frame 91, from the vicinity of the right-hand side end portion of the main body via the ink jet head 1 to the vicinity of the opposite end portion (referred to as the "main body left side" hereinafter). This reciprocative running is performed in the space between the ink jet head 1 and the sheet conveyance mechanism 10. The range of the reciprocative running of the carriage 22 is restricted by end pins 28*a* and 28*b* attached to the main frame 91 in the vicinity of both ends of the guide bar 92. In normal printing, the carriage 22 moves to a position (referred to as an "accommodating position" hereinafter) so as to abut against the end pin 28*a* of the main body right side. At this time, the purge sheet 21 is located in the printing position (A in the figure). In a purge operation, the carriage 22 moves to a position (referred to as a "draw-out position" hereinafter) so as to abut against the end pin 28*b* of the main body left side. At this time, the purge sheet 21 is located in the purge position. (B in the figure). The carriage 22 includes: a carriage frame 31; a running belt 32 for causing the carriage 22 to travel; a comb unit (ink receiving member) 33; a wiper unit 34; a cam plate 35, and a sheet holder 36 (see FIGS. 7A and 7B).

The carriage frame 31 is a thin plate member which has a C shape concaved on top and which extends from the main body front side end portion to the main body rear side end portion (see FIG. 1 and FIG. 2). Each of the two end portions of the carriage frame 31 is attached to the corresponding guide bar 92 in a freely slidable manner. The carriage frame 31 supports the comb unit 33, the wiper unit 34, the cam plate 35, and the sheet holder 36 (see FIG. 8).

The running belt 32 is a ring shaped belt wound around so as to link two running belt rollers 37*a* and 37*b* supported in a freely rotatable manner in a perpendicular direction, respectively, on the main body front side and the main body rear side of the main frame 91. The end portions of the carriage frame 31 are fixed, respectively, above the ring of the running belt 32. A sub-pulley 38 having a larger diameter than the running belt roller 37*a* is connected to the running belt roller 37*a* coaxially. As described later, when a torque is transmitted to the sub-pulley 38, the running belt roller 37*a* revolves integrally with the sub-pulley 38. As a result, the carriage 22 travels along the guide bar 92.

The comb unit 33 serves to remove ink adhered to the ink discharging surface 4*a*. The comb unit 33 includes: four thin plates (protrusions) 40 extending in one direction (a direction perpendicular to the traveling direction of the carriage 22) and arranged such that their planes oppose mutually at predetermined intervals; a thin plate holder 41 for supporting these four thin plates 40; and restriction members 43. When the carriage 22 is positioned under the ink discharging surface 4*a*, the upper edges of the four thin plates 40 oppose the ink discharging surface 4*a*, while the longitudinal direction of the plates crosses all over the transverse direction of the four ink discharging surfaces 4*a*. The thin plate holder 41 is supported in a displaceable manner in a direction perpendicular to the ink discharging surface 4*a* of the head body 2, and is biased toward the ink discharging surface 4*a* by a spring 42. As shown in FIG. 7, the restriction members 43 prevent the lower edges of the thin plates 40 from contacting with the purge sheet 21 arranged so as to oppose the bottom surface of the carriage 22. The restriction members 43 protrude from the thin plate holder 41 across the thin plates 40 toward the sheet conveyance belt 11 (downward). Three such restriction members are arranged along the longitudinal direction of the thin plates 40.

The wiper unit 34 serves to remove ink adhered to the ink discharging surface 4*a*. The wiper unit includes: four wipers 45 each having a sheet shape extending in one direction; and a wiper holder 46 for supporting the four wipers 45. When the carriage 22 is positioned under the ink discharging surface 4*a* of the head body 2, the upper edges of the wipers 45 oppose the ink discharging surface 4*a* of the head body 2, while the longitudinal direction of each wiper aligns with the transverse direction of the corresponding head body 2 (see FIG. 4). The wiper holder 46 is supported in a displaceable manner in a direction perpendicular to the ink discharging surface 4*a* of the head body 2, and is biased upward by a spring 47. When the wiper holder 46 displaces upward, the upper edges of the wipers 45 contact with the ink discharging surface 4*a* of the head body 2. When the wiper holder displaces downward, the upper edges of the wipers 45 depart from the ink discharging surface 4*a* of the head body 2.

The cam plate 35 is a cam member having the shape of a thin plate and extending in one direction, and serves to control the position of the thin plate holder 41 and the wiper holder 46. As shown in FIGS. 7A and 7B, the cam plate 35 is arranged such that its longitudinal direction aligns with the traveling direction of the carriage 22. Furthermore, the cam plate is supported in a displaceable manner in the traveling direction of the carriage 22. In the bottom end portion of the cam plate, a cam surface is formed where a low position area 35*a* formed at the main body right side and a high position area 35*b* formed at the main body left side gradually continue to each other. The thin plate holder 41 and the wiper holder 46 are always biased upward by the springs 42 and 47. Thus, cylindrical members 41*a* and 46*a* formed in the thin plate holder 41 and the wiper holder 46 are always in contact with the bottom end portion of the cam plate 35.

As shown in FIG. 7A, when the cam plate 35 displaces to the main body left side, the low position area 35*a* is located in a position opposing the cylindrical members 41*a* and 46*a* of the thin plate holder 41 and the wiper holder 46. Accordingly, the cylindrical members 41*a* and 46*a* of the thin plate holder 41 and the wiper holder 46 are pushed by the low position area 35*a*, and thereby displaced downward. On the contrary, as shown in FIG. 7B, when the cam plate 35 displaces to the main body right side, the high position area 35*b* is located in a position opposing the cylindrical members 41*a* and 46*a* of the thin plate holder 41 and the wiper holder 46. Thus, since the thin plate holder 41 and the wiper holder 46 are biased upward, the cylindrical members 41*a* and 46*a* of the thin plate holder 41 and the wiper holder 46 follow the high position area 35*b*, and thereby move upward.

The sheet holder (fixing member) 36 is supported in a rotatable manner on the bottom surface side of the carriage frame 31. Furthermore, one edge portion of the purge sheet 21 is fixed to the sheet holder. The distance in the longitudinal direction of the sheet holder 36 is shorter than that in the width direction of the purge sheet 21. The center portion of the one edge portion of the purge sheet 21 is fixed to the bottom surface of the sheet holder 36, while both edges of the one edge portion of the purge sheet 21 are fixed to both end surfaces of the sheet holder 36, in a state bent in the directions indicated by arrows in FIG. 8. Thus, in the one edge portion of the purge sheet 21, the both edges in the width direction are bent toward the ink discharging surface 4*a*. Accordingly, the both edges in the width direction of the purge sheet 21 are maintained in a bent state toward the ink discharging surface 4*a*, along a certain distance from the one edge portion fixed to the sheet holder 36 toward the other edge portion fixed to the roll-up shaft 25.

Referring to FIGS. 4, 5, 6A and 6B, the tension unit 24 is described below. As shown in FIGS. 4 and 5, the tension unit 24 includes a tension roller 50 that serves as the sheet abutting member, a displacement arm 51 that serves as the displacing member, and a wire roller 52. The peripheral surface of the tension roller 50 abuts against the sheet back surface of the purge sheet 21 along the width direction of the purge sheet 21, and thereby imparts a tension to the purge sheet 21. The tension roller 50 is supported in a displaceable manner in vertical directions under the carriage 22 located in the accommodating position. That is, as shown in FIGS. 6A and 6B, the tension roller 50 is guided in vertical directions in a configuration that an end portion 50*a* of the tension roller 50 is slidably inserted into an elongate hole 91*b* formed in the main frame 91.

When the purge sheet 21 is located in the purge position, the tension roller 50 is displaced and located in the uppermost position (a first position) which is a position where the tension imparted from the tension roller 50 to the purge sheet 21 reaches a maximum. When the purge sheet 21 is located in the printing position, the tension roller 50 is displaced and located in the lowermost position (a second position) which is a position where the tension imparted from the tension roller 50 to the purge sheet 21 reaches a minimum. As such, the displacement range of the tension roller 50 is set such that when the position of the tension roller 50 displaces upward, the tension imparted to the purge sheet 21 becomes strong, while when the position displaces downward, the tension imparted to the purgesheet 21 becomes weak. The uppermost position is set to be between the ink discharging surface 4*a* and the conveyance surface of the sheet conveyance mechanism 10, and hence overlaps with the position of the carriage 22 located in the accommodating position. On the other hand, the lowermost position does not overlap with the position of the carriage 22 located in the accommodating position. Furthermore, the distance between the lowermost position and the sheet holder 36 when the purge sheet 21 is in the printing position is longer than the distance between the uppermost position and the sheet holder 36 when the purge sheet 21 is in the printing position.

The displacement arm 51 serves to displace the tension roller 50. The displacement arm 51 is a thin-plate shaped member extending in one direction. In each protruded area of the main body front side and the main body rear side of the main frame 91 at the main body right side, the displacement arm 51 is supported in a manner permitting free swing in a state that one end of the longitudinal direction is centered while the other end is located downward. The other end of each displacement arm 51 is connected to the corresponding shaft end of the tension roller 50 via a wire 54. A cylindrical member 51*a* for abutting against the abutting member 31*a* formed in the carriage frame 31 is formed in the displacement arm 51. The displacement arm 51 is biased in a direction so as to swing to the main body left side by a spring 55. The wire roller 52 is attached coaxially to the running belt roller 37*a* and in a freely rotatable manner, and thereby guides the wire 54 so as to assist the operation of converting the motion of the wire 54 in the swing direction of the displacement arm 51 into the motion of the displacement direction of the tension roller 50.

The spring 55 biases the displacement arm 51 in a direction so as to swing to the main body left side, and hence the displacement arm 51 is biased always in a direction so as to swing to the main body right side.

The sheet roll-up shaft 25 rolls up and accommodates the purge sheet 21 in the clockwise direction viewed from the main body back side, and is arranged under the tension roller 50. The sheet roll-up shaft 25 includes a torque transmission mechanism 60.

Figure 9:
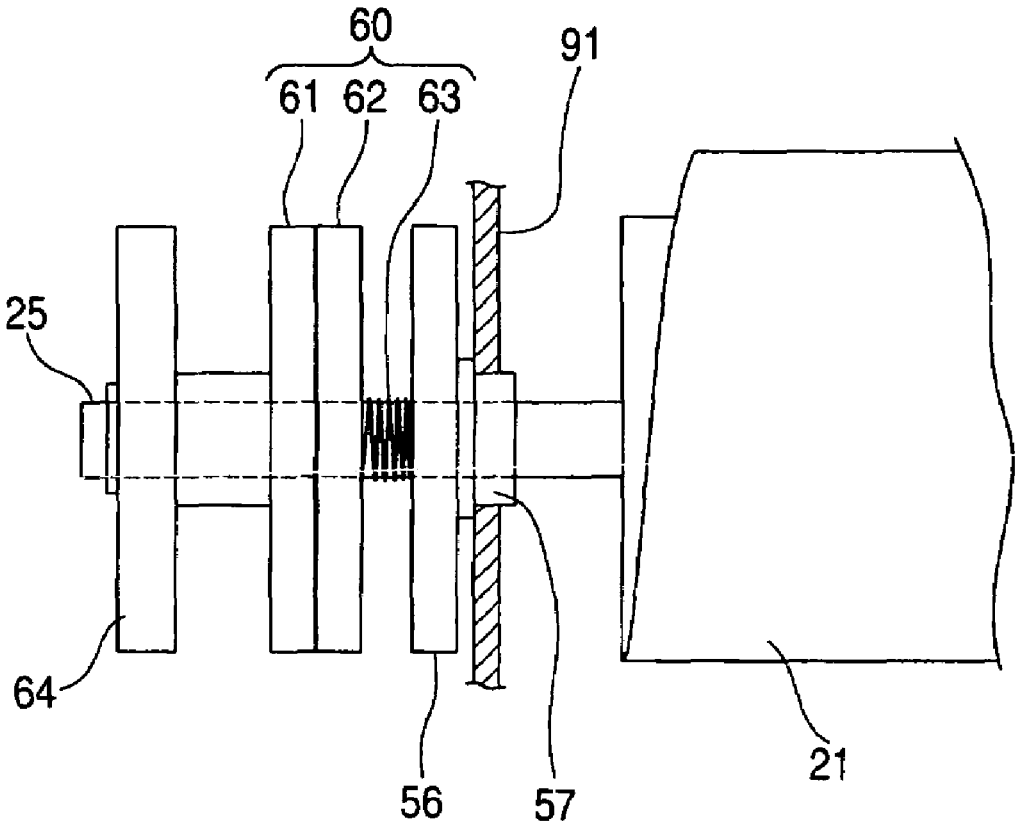
FIG. 9 is an enlarged view of a torque transmission mechanism shown in FIG. 4.

Next, the torque transmission mechanism 60 is described below with reference to FIG. 9. FIG. 9 is an enlarged view of the torque transmission mechanism 60. As shown in FIG. 9, the torque transmission mechanism 60 includes: a roll-up gear 64 to which a torque is transmitted; an input plate 61 linked coaxially to the roll-up gear 64; an output plate 62 independent of the roll-up gear 64 and the input plate 61, but linked coaxially to the sheet roll-up shaft 25; a spring receiving section 56 arranged coaxially to the output plate 62 via a spring 63 in between; and a bearing 57 fixed to the main frame 91 and contacting with the spring receiving section 56. The input plate 61 and the output plate 62 are arranged such that their planes oppose coaxially to each other. The plane of the output plate 62 can be displaced in an axial direction. Furthermore, the output plate is biased in a direction so as to approach the plane of the input plate 61 along the axial direction by the spring 63. Accordingly, the input plate 61 and the output plate 62 are always in contact with each other with a predetermined pressure. The spring receiving section 56 is freely rotatable relative to the sheet roll-up shaft 25, and contacts with the bearing 57 with a frictional force. When no tension is imparted to the purge sheet 21, the input plate 61 and the output plate 62 rotate in an integrated manner. Accordingly, the torque transmitted from the roll-up gear 64 to the input plate 61 is further transmitted to the output plate 62 so that the sheet roll-up shaft 25 rotates. When the tension imparted to the purge sheet 21 exceeds the frictional force generated between the input plate 61 and the output plate 62, the output plate 62 slips relative to the input plate 61. Accordingly, the torque transmitted from the roll-up gear 64 to the input plate 61 is not transmitted to the output plate 62.

As shown in FIG. 1 and FIG. 4, each of the blades 26*a*-26*c* controls the flow of ink on the purge sheet 21. Each of ink scraping elements 39*a*-39*c* is attached to an end portion of the longitudinal direction of each thin plate member extending in one direction. When the ink scraping elements 39*a*-39*c* contact with the purge sheet 21, the ink adhered to the purge sheet 21 is scraped or guided. The two ink guiding blades (ink guiding members) 26*a* serve to guide the ink on the sheet front surface toward the center in the width direction of the purge sheet 21. The two ink guiding blades are arranged between the tension roller 50 and the sheet roll-up shaft 25 at both edges of the width direction of the sheet front surface, such that the distance between the ink scraping elements 39*a* become narrow as approaching the sheet roll-up shaft 25. Furthermore, in the ink guiding blades 26*a,* the ink scraping elements 39*a* contact with the sheet front surface in a manner oriented from the sheet roll-up shaft 25 to the tension roller 50.

The ink scraping blade (ink scraping member) 26*b* serves to scrape from the sheet front surface the ink guided toward the center in the width direction of the sheet front surface by the ink guiding blades 26*a.* The ink scraping blade is arranged under the ink guiding blades 26*a* such that the longitudinal direction of the ink scraping blade 21 aligns with the width direction of the purge sheet. In the ink scraping blade 26*b,* the ink scraping element 39*b* contacts with the sheet front surface in a manner oriented from the sheet roll-up shaft 25 to the tension roller 50. The cleaning blade (cleaning member) 26*c* serves to scrape the ink adhered to the sheet back surface, when the purge sheet 21 travels from the printing position to the purge position. The cleaning blade is arranged between the tension roller 50 and the sheet roll-up shaft 25 such that the longitudinal direction of the blade aligns with the width direction of the purge sheet 21. In the cleaning blade 26*c,* the ink scraping element 39*c* contacts with the sheet back surface in a manner oriented from the tension roller 50 to the sheet roll-up shaft 25.

The disposed ink tank 27 is a tank having approximately the shape of a rectangular parallelepiped, and serves to store the ink discharged from the head body 2 in a purge operation. The disposed ink tank 27 is arranged under the sheet roll-up shaft 25 in a position where the ink scraped by the ink scraping blade 26*b* flows across the ink scraping blade 26*b* and then falls freely (see FIG. 4).

Figure 10:
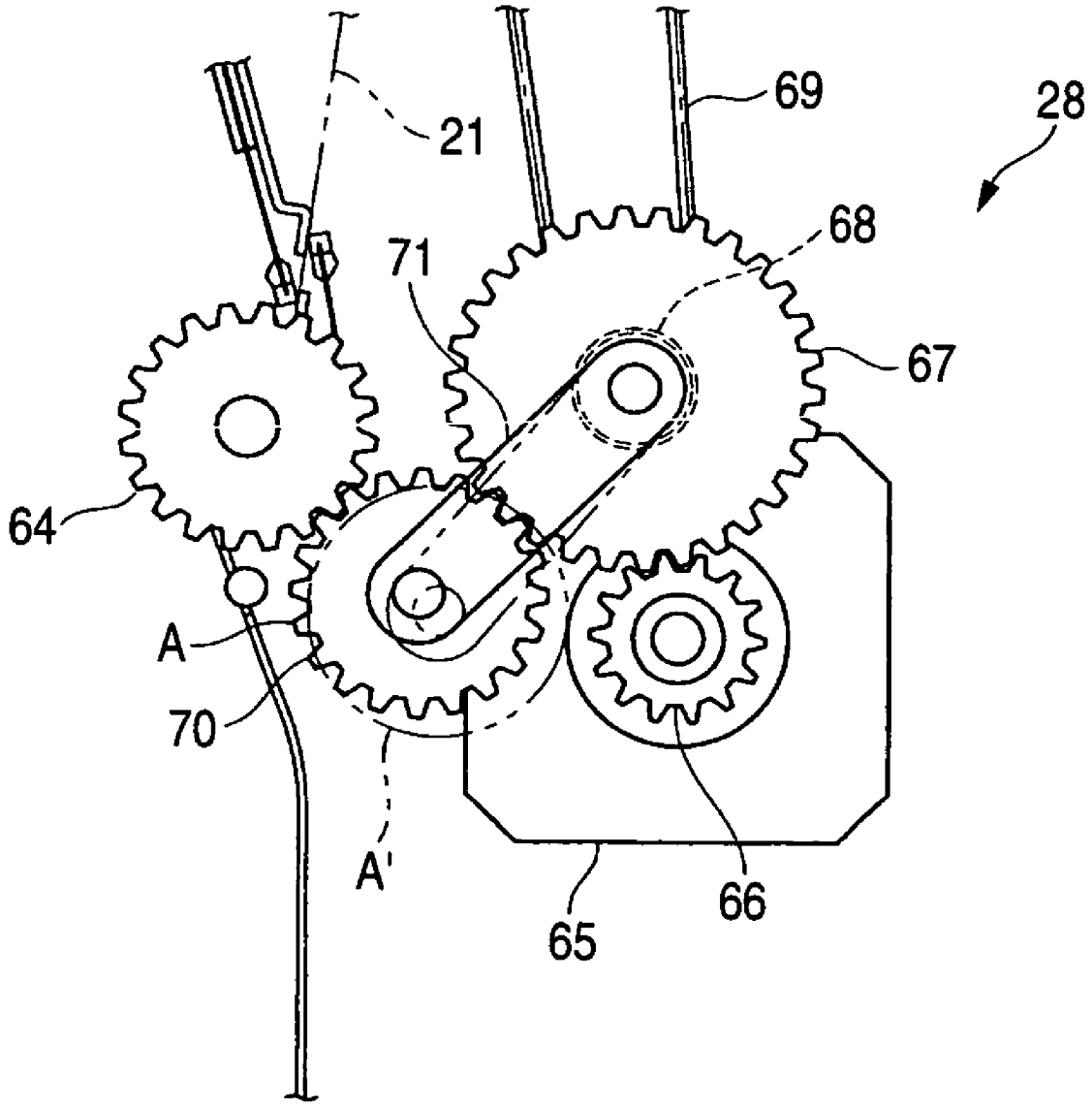
FIG. 10 is an enlarged view of a maintenance drive mechanism shown in FIG. 5.

Next, the maintenance drive mechanism 28 is described below with reference to FIG. 10. FIG. 10 is an enlarged view of the maintenance drive mechanism 28 of FIG. 5. The maintenance drive mechanism 28 serves to drive the carriage 22 and the sheet roll-up shaft 25, and includes a maintenance drive motor 65, a maintenance drive gear 66, a carriage gear 67, a carriage gear pulley 68, a carriage gear belt 69, and a planet gear 70. The maintenance drive motor 65 is a motor for generating a torque in an arbitrary direction of rotation (selected from the clockwise direction: CW and the counterclockwise direction: CCW) in response to an instruction from the control unit 80. The maintenance drive motor 65 is arranged under the sheet roll-up shaft 25 such that an end portion of the output shaft of the motor is oriented toward the main body rear side. The maintenance drive gear 66 is a gear connected directly to the output shaft of the maintenance drive motor 65.

The carriage gear 67 is a gear for causing the carriage 22 to travel, and is arranged above the maintenance drive gear 66 in a state engaged with the maintenance drive gear 66. The carriage gear pulley 68 is connected coaxially to the carriage gear 67. The carriage gear belt 69 is an endless shaped belt wound around so as to link the carriage gear pulley 68 and the sub-pulley 38 of the running belt roller 37*a.* Accordingly, the torque of the carriage gear 67 is transmitted to the sub-pulley 38 via the carriage gear pulley 68 and the carriage gear belt 69.

The planet gear 70 is a gear for transmitting a torque to the roll-up gear 64 and thereby rotates the sheet roll-up shaft 25. The planet gear 70 is arranged at the main body right side of the roll-up gear 64 of the torque transmission mechanism 60, in a state engaged with the carriage gear 67. The planet gear 70 is provided with a connecting plate 71 for linking the shaft of the planet gear 70 with the shaft of the carriage gear 67, and thereby revolves around the periphery of the carriage gear 67 serving as a sun gear. When the planet gear 70 revolves to the main body left side, the planet gear engages with the roll-up gear 64 so that a torque is transmitted from the planet gear 70 to the roll-up gear 64 (A in the figure). On the contrary, when the planet gear 70 revolves to the main body right side, the planet gear 70 departs from the roll-up gear 64 so that no torque is transmitted from the planet gear 70 to the roll-up gear 64 (A' in the figure). The revolution range of the planet gear 70 is restricted such that the planet gear 70 does not interfere with the maintenance drive gear 66 or the like when the planet gear revolves toward the main body front side.

Figure 11A:
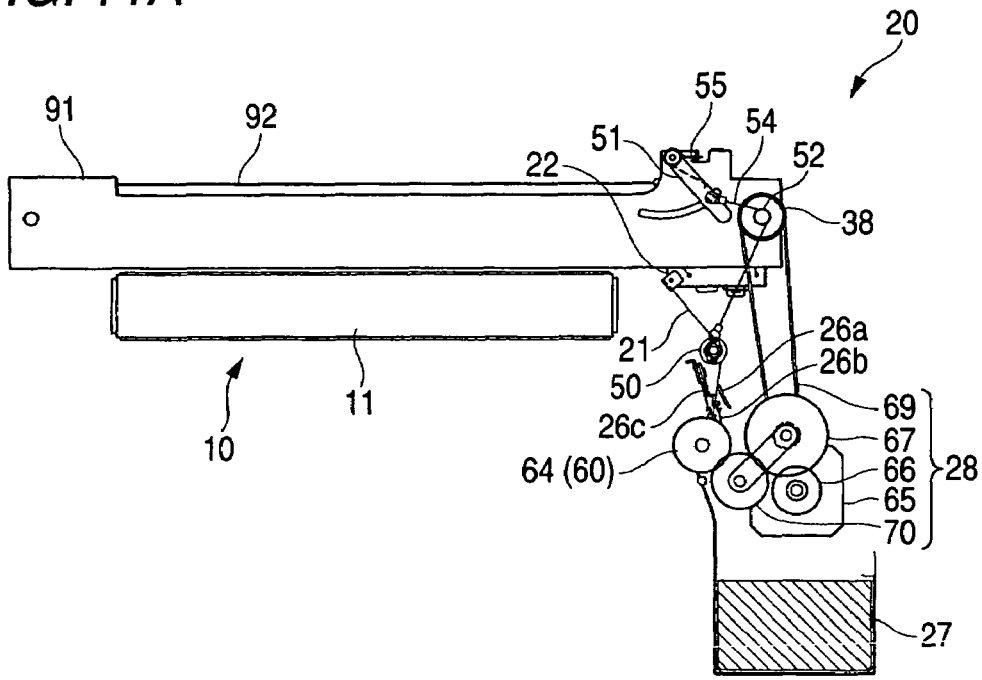
FIGS. 11A and 11B are external views showing the operation of a maintenance mechanism shown in FIG. 1.
Figure 11B:
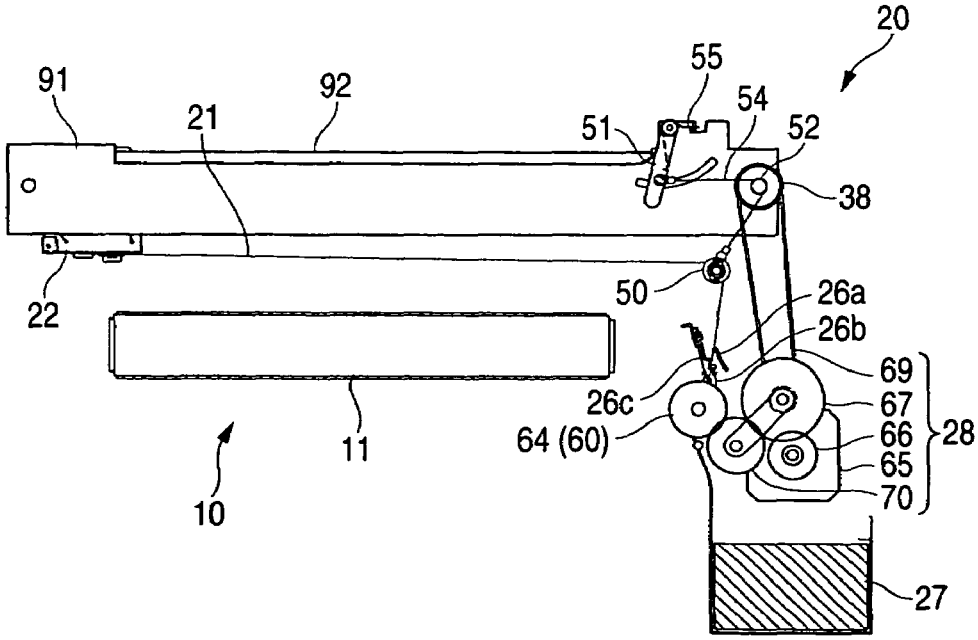

Next, the operation of the maintenance mechanism 20 is described below with reference to FIGS. 11A and 11B. FIGS. 11A and 11B are external views showing the operation of the maintenance mechanism 20. The operation of the maintenance mechanism 20 is separated into: a purge preparing operation of moving the purge sheet 21 from the printing position to the purge position; and an ink collecting operation of moving the purge sheet 21 from the purge position to the printing position. These operations are described below in this order.

The purge preparing operation is described first. In the normal printing state, as shown in FIG. 11A, the carriage 22 waits in the accommodating position, while the purge sheet 21 is rolled around the sheet roll-up shaft 25, and is located in the printing position. At this time, the cylindrical member of the displacement arm 51 is pushed by the abutting member 31*a* of the carriage 22 (see FIG. 1) so that the displacement arm 51 swings to the main body right side. Thus, the tension roller 50 is pulled by the sent-out distance of the wire 54, and thereby displaced in the lowermost position. Furthermore, the cam plate 35 is pushed by the end pin 28*a,* and thereby displaced at the main body left side. Accordingly, the cylindrical members 41*a* and 46*a* of the thin plate holder 41 and the wiper holder 46 are located in a position opposing the low position area 35*a.* As a result, the cylindrical members 41*a* and 46*a* of the thin plate holder 41 and the wiper holder 46 are pushed by the low position area 35*a* of the cam surface, and thereby displaced downward.

When the control unit 80 decides to perform a purge operation in the head body 2, the control unit starts a purge preparing operation. First, the control unit 80 moves the sheet conveyance mechanism 10 downward. Then, the control unit 80 causes the maintenance drive motor 65 to revolve in the CW direction (clockwise direction: a first direction, when the maintenance drive motor 65 is viewed from the front side of the main body). The torque of the maintenance drive motor 65 revolving in the CW direction is transmitted to the carriage gear 67 as a torque in the counterclockwise direction via the maintenance drive gear 66. The torque transmitted to the carriage gear 67 is transmitted to the carriage gear belt 69 via the carriage gear pulley 68, and further transmitted to the sub-pulley 38 of the running belt roller 37*a* as a torque in the counterclockwise direction. The torque transmitted to the sub-pulley 38 is transmitted to the running belt roller 37*a* as a torque in the counterclockwise direction via the running belt roller 37*a*. When the running belt roller 37*a* revolves counterclockwise, the carriage 22 fixed above the running belt 32 starts to travel from the accommodating position toward the main body left side.

Once the torque is transmitted to the carriage gear 67, the carriage gear 67 causes the planet gear 70 to revolve to the main body right side, and thereby causes the planet gear 70 to depart from the roll-up gear 64. When the planet gear 70 departs from the roll-up gear 64, the sheet roll-up shaft 25 can freely revolve with a predetermined frictional resistance.

When the carriage 22 starts to travel from the accommodating position, the abutting member 31*a* of the carriage frame 31 moves in a direction so as to depart from the displacement arm 51. The displacement arm 51 biased toward the main body left side follows the abutting member 31*a* of the carriage frame 31, and thereby swings toward the main body left side. When the displacement arm 51 swings to the main body left side, the tension roller 50 is pulled by the wire 54 and thereby displaced upward toward the uppermost position. Furthermore, when the carriage 22 travels, the purge sheet 21 fixed to the sheet holder 36 is drawn out. When the purge sheet 21 is drawn out by the carriage 22, the purge sheet 21 is unrolled from the sheet roll-up shaft 25. At this time, ink adhered to the sheet back surface of the purge sheet 21 is scraped by the cleaning blade 26*c*. The ink scraped by the cleaning blade 26*c* falls into the disposed ink tank 27.

When the carriage 22 travels further, the purge sheet 21 is unrolled further from the sheet roll-up shaft 25. Then, until the abutting member of the carriage frame departs from the cylindrical member of the displacement arm 51, the tension roller 50 is displaced upward further and located into the uppermost position. When the tension roller 50 is displaced upward, the elevation of the tension roller 50 goes beyond the conveyance surface of the sheet conveyance mechanism 10, and thereby approaches the elevation of the sheet holder 36 of the carriage 22. Thus, the inclination of the purge sheet 21 positioned between the sheet holder 36 and the tension roller 50 becomes less steep. Then, the sheet holder 36 rotates in accordance with this angle.

When the carriage 22 travels further, as shown in FIG. 11B, the carriage frame 31 abuts against the end pin 28*b* so that the carriage 22 reaches the draw-out position. At this time, the cam plate 35 is pushed by the end pin 28*b*, and thereby displaced to the main body right side. Thus, the cylindrical members 41*a* and 46*a* of the thin plate holder 41 and the wiper holder 46 are located in a position opposing the high position area 35*b*. Accordingly, the cylindrical members 41*a* and 46*a* of the thin plate holder 41 and the wiper holder 46 follow the high position area 35*b* and thereby displace upward.

[1-0063]

After that, the control unit 80 causes the maintenance drive motor 65 to revolve slightly in the CCW direction (counterclockwise direction: a second direction, when the maintenance drive motor 65 is viewed from the front side of the main body). The torque of the maintenance drive motor 65 revolved in the CCW direction is transmitted to the carriage gear 67 as a torque in the clockwise direction via the maintenance drive gear 66. The torque transmitted to the carriage gear 67 is transmitted to the carriage gear belt 69 via the carriage gear pulley 68, and further transmitted to the sub-pulley 38 of the running belt roller 37*a* as a torque in the clockwise direction. The torque transmitted to the sub-pulley 38 is transmitted to the running belt roller 37*a* as a torque in the clockwise direction via the running belt roller 37*a*. When the running belt roller 37*a* revolves clockwise, the carriage 22 fixed above the running belt roller 37*a* slightly travels from the draw-out position toward the main body right side.

Once the torque is transmitted to the carriage gear 67, the carriage gear 67 causes the planet gear 70 to revolve to the main body left side, and thereby causes the planet gear 70 to engage with the roll-up gear 64 so that the torque of the carriage gear 67 is transmitted to the planet gear 70 as a torque in the counterclockwise direction. When the planet gear 70 is engaged with the roll-up gear 64, the torque of the planet gear 70 is transmitted to the input plate 61 as a torque in the clockwise direction via the roll-up gear 64. The torque of the input plate 61 relative to the output plate 62 does not exceed the frictional resistance generated between the input plate 61 and the output plate 62. Thus, the torque of the input plate 61 is transmitted to the output plate 62. The torque transmitted to the output plate 62 is further transmitted to the sheet roll-up shaft 25. As a result, the sheet roll-up shaft 25 rotates in the clockwise direction and thereby rolls up the purge sheet 21 slightly. At this time, the speed that the sheet roll-up shaft 25 rolls up the purge sheet 21 is faster than that the carriage 22 moves the purge sheet 21. Thus, the sheet roll-up shaft 25 pulls the purge sheet 21, and thereby generates a tension in the purge sheet 21. This tension has a magnitude that the input plate 61 and the output plate 62 slip toward each other. Then, the purge preparing operation is completed. At this time, the purge sheet 21 is located in the purge position. Furthermore, both edges in the width direction of the purge sheet 21 in the edge portion of the longitudinal direction are bent toward the ink discharging surface 4*a* owing to its own internal stress and by the, sheet holder 36. Furthermore, the sheet holder 36 is positioned above the tension roller 50. Thus, the purge sheet 21 is inclined downward from the sheet holder 36 to the tension roller 50.

After that, the control unit 80 performs a purge operation and causes a predetermined amount of ink to be discharged from all the nozzles 8. The ink discharged in the purge operation is received on the sheet front surface of the purge sheet 21. As described above, the cross section in the width direction of the purge sheet 21 is concave toward the ink discharging surface 4*a*. Thus, the ink on the sheet front surface moves toward the center of the purge sheet 21 along the traveling direction of the carriage 22. Water repellent finishing is applied to the sheet front surface of the purge sheet 21. Thus, a majority of the ink on the sheet front surface flows and falls to the tension roller 50 side (in a direction approaching the disposed ink tank 27) along the inclination of the purge sheet 21. The ink that has flowed and reached the tension roller 50 side flows further toward the ink guiding blades 26*a* along the sheet front surface of the purge sheet 21. The ink that has flowed and reached the ink guiding blades 26*a* is guided by the ink guiding blades 26*a*, and thereby guided to the center in the longitudinal direction of the sheet front surface. The ink having guided to the center is scraped by the ink scraping blade 26*b* arranged downstream, and thereby stored into the disposed ink tank 27.

Figure 12B:
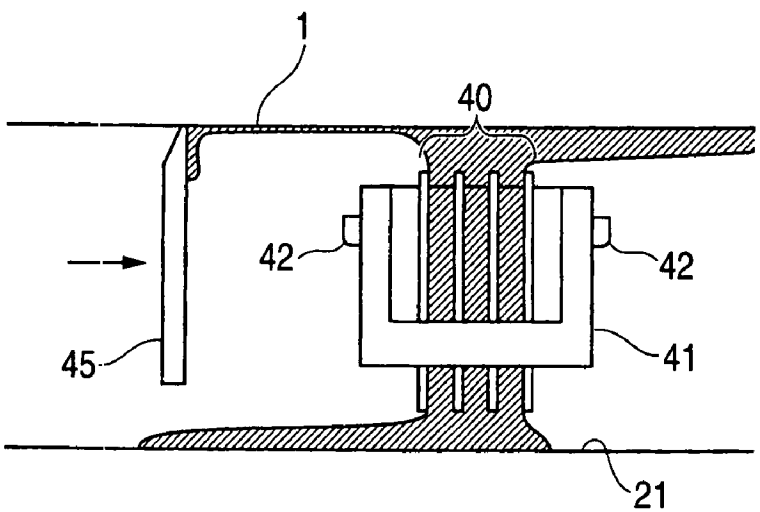
FIGS. 12A and 12B are diagrams showing an ink collecting operation of thin plates and a wiper provided in a carriage shown in FIG. 1.
Figure 12A:
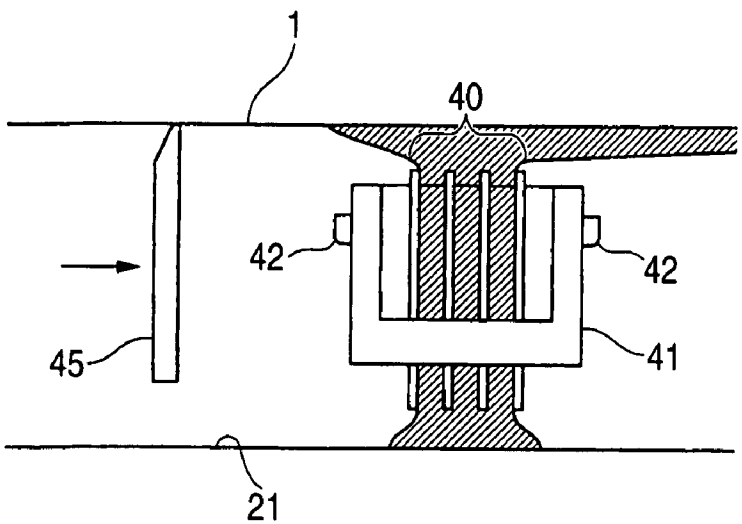

Next, the ink collecting operation is described below with reference further to FIGS. 12A and 12B. FIGS. 12A and 12B are diagrams showing the ink collecting operation of the thin plates 40 and the wiper 45. An arrow in the figure indicates the direction of movement of the thin plates 40 and the wiper 45. After the purge operation is completed, the control unit 80 starts an ink collecting operation for the ink adhered to the surface of the purge sheet 21 and the ink adhered to the ink discharging surface 4*a* of the head body. First, the control unit 80 causes the maintenance drive motor 65 to revolve in the CCW direction. As described above, the torque from the maintenance drive motor 65 is transmitted successively so that the carriage 22 travels toward the accommodating position. Almost at the same time, the sheet roll-up shaft 25 rotates and thereby rolls up the purge sheet 21 so that the purge sheet 21 moves from the purge position to the printing position. Thus, no slack occurs in the purge sheet 21.

At this time, the speed at which the sheet roll-up shaft 25 rolls up the purge sheet 21 is faster than the carriage 22 which moves the purge sheet 21 to the printing position. Thus, the sheet roll-up shaft 25 pulls the purge sheet 21, and thereby generates a tension in the purge sheet 21. When the tension exceeds the frictional resistance, the output plate 62 slips relative to the input plate 61 so that the torque transmitted to the input plate 61 is not transmitted to the output plate 62. When the torque transmitted to the input plate 61 is not transmitted to the output plate 62, the tension decreases in the purge sheet 21. When the tension becomes smaller again than the frictional force generated between the input plate 61 and the output plate 62, the input plate 61 and the output plate 62 revolve in an integrated manner. As such, the torque transmission mechanism 60 transmits the torque of the input plate 61 to the sheet roll-up shaft 25 intermittently. This allows the purge sheet 21 to travel from the purge position to the printing position in a manner maintaining a predetermined tension.

When the carriage 22 travels toward the accommodating position, as shown in FIG. 12A, the upper edges of the four thin plates 40 of the thin plate holder 41 having been displaced upward are positioned in the vicinity of the ink discharging surface 4*a* of the head body 2. Thus, the upper edges of the four thin plates 40 contact with ink adhered to the ink discharging surface 4*a*. Accordingly, the ink adhered to the ink discharging surface 4*a* is absorbed into the gaps between the planes of the four thin plates by the capillary force. The absorbed ink falls from the bottom end portion of the thin plate holder 41 to the sheet front surface on the purge sheet 21 owing to gravity. Then, as shown in FIG. 12B, the upper edges of the wiper 45 of the wiper holder 46 having been displaced upward contact with the ink discharging surface 4*a*. When the upper edges of the wiper travels in a state contacting with the ink discharging surface 4*a*, the remainder of the ink adhered to the ink discharging surface 4*a* is scraped and collected onto the sheet front surface of the purge sheet 21. At this time, uniform meniscuses are formed in all the nozzles 8. As described above, the cross section in the width direction of the purge sheet 21 is concave toward the ink discharging surface 4*a*. Thus, the ink on the sheet front surface moves toward the center of the purge sheet 21 along the traveling direction of the carriage 22.

When the carriage 22 travels and thereby reaches the vicinity of the accommodating position, the abutting member 31*a* of the carriage frame 31 abuts against the cylindrical member 51*a* of the displacement arm 51 having swung to the main body left side. After the carriage 22 travels further, the a butting member 31*a* of the carriage frame 31 pushes the cylindrical member 51*a* of the displacement arm 51, and thereby causes the displacement arm 51 to swing to the main body right side. When the displacement arm 51 swings to the main body right side, the wire 54 connected to the displacement arm 51 is sent out. Thus, the tension roller 50 connected to this wire displaces downward toward the lowermost position. When the tension roller 50 displaces downward, the distance from the sheet holder 36 increases, and so does the inclination of the purge sheet 21 toward the disposed ink tank 27.

As such, the ink collected onto the sheet front surface of the purge sheet 21 by the four thin plates 40 and the wiper 45 flows along the sheet front surface of the purge sheet 21. Then, the ink flowing on the sheet front surface flows further across the tension roller 50 toward the ink guiding blades 26*a*. The ink having flowed to the ink guiding blades 26*a* is guided by the ink guiding blades 26*a*, and thereby guided to the center in the longitudinal direction of the sheet front surface. The ink having been guided to the center is scraped by the ink scraping blade 26*b* arranged downstream, and thereby stored into the disposed ink tank 27. Then, the ink collecting operation is completed.

When sheet jam occurs in the sheet conveyance mechanism 10, the control unit 80 performs a purge preparing operation described above. Accordingly, the ink discharging surface 4*a* of the head body 2 is covered by the purge sheet 21 located in the purge position. Then, the control unit 80 issues to the user a request for resolving the sheet jam, and then waits until the user resolves the sheet jam. When the sheet jam is resolved, the control unit 80 performs an ink collecting operation. Thus, the purge sheet 21 moves to the accommodating position so that the system returns to the state of normal printing.

According to the first embodiment described above, when the purge sheet 21 is in the purge position, the vicinity of the edge portions in the width direction of the purge sheet 21 bend toward the ink discharging surface 4*a* owing to the self internal stress. Thus, a simple configuration can cause the cross section in the width direction of the purge sheet 21 to be concave toward the ink discharging surface 4*a*. Accordingly, the ink on the purge sheet 21 easily moves to the center of the purge sheet 21 along the traveling direction of the carriage 22. As a result, all ink is collected without leakage of the ink from the edge portion of the purge sheet 21. Furthermore, the purge sheet 21 need not be changed. This allows to reduce the running cost of the printing.

In particular, both edges in the width direction of the purge sheet 21 are bent and fixed to the side surfaces of the sheet holder 36. Thus, the cross section of the purge sheet 21 easily becomes concave toward the ink discharging surface 4*a*.

Furthermore, the purge sheet 21 has flexibility. Thus, in normal printing, the purge sheet 21 can be rolled up and accommodated around the sheet roll-up shaft 25. This allows to reduce the maintenance mechanism 20 in size.

In addition, the wiper 45 is attached to the carriage 22. Thus, the traveling of the carriage serves simultaneously as the moving of the purge sheet 21 and the removal of the ink adhered to the ink discharging surface 4*a*. This allows to reduce the maintenance mechanism 20 in size.

Furthermore, when the purge sheet 21 moves from the purge position to the printing position, the thin plates 40 of the comb unit 33 are located upstream from the wiper 45. Thus, a majority of the ink adhered to the ink discharging surface 4*a* is removed by the thin plates 40. After that, the remaining ink is removed by the wiper 45. This allows to efficiently remove the ink adhered to the ink discharging surface 4*a*.

Furthermore, the restriction member 43 prevents the edge portions of the thin plates 40 from contacting with the sheet front surface of the purge sheet 21. Thus, the ink received by the thin plates 40 falls onto the purge sheet 21 efficiently by gravity.

In addition, the sheet holder 36 is rotatable. This allows to reduce the stress generated in the purge sheet 21 when the carriage 22 travels.

In addition, water repellent finishing is applied to the sheet front surface and the sheet back surface of the purge sheet 21. Thus, the ink on the sheet front surface and the sheet back surface of the purge sheet 21 moves efficiently. Furthermore, the ink on the sheet front surface and the sheet back surface is removed efficiently.

Furthermore, the two ink guiding blades 26*a* guide the ink on the purge sheet 21 to the ejection position. Thus, the ink is ejected efficiently.

Furthermore, the ink scraping blade 26*b* scrapes the ink on the sheet front surface of the purge sheet 21 into the disposed ink tank. Thus, the ink is ejected efficiently.

In addition, the plane of the purge sheet 21 is inclined downward toward the sheet roll-up shaft 25. Thus, the ink on the sheet front surface is ejected efficiently.

Furthermore, when a sheet jam occurs, the control unit 80 moves the purge sheet 21 to the purge position. This prevents the ink discharging surface 4*a* from contacting directly with foreign materials such as a user's hands during the work of removing the sheet. Thus, the ink discharging surface 4*a* is protected. Furthermore, at that time, the cleaning blade 26*c* removes the ink adhered to the sheet back surface of the purge sheet 21. This prevents a user's hands from being blotted.

According to the first embodiment described above, when the purge sheet 21 is moved from the purge position to the printing position, the tension roller 50 is displaced from the uppermost position to the lowermost position so that the purge sheet 21 can be inclined steeply toward the disposed ink tank 27. This allows the ink on the purge sheet 21 to flow efficiently, and thereby hardly stagnate on the purge sheet 21.

Furthermore, the uppermost position is a position higher than the conveyance surface of the sheet conveyance mechanism 10. This prevents the purge sheet 21 located in the purge position from interfering with the sheet conveyance mechanism 10.

Furthermore, the distance between the lowermost position and the sheet holder 36 when the purge sheet 21 is in the printing position is longer than the distance between the uppermost position and the sheet holder 36 when the purge sheet 21 is in the printing position. By virtue of this, when the purge sheet 21 is located in the printing position, the tension is reduced that is generated in the bending areas of the edge portions of the purge sheet 21 in the width direction in the vicinity of the carriage 22. This prevents the bending portions of the purge sheet 21 from being bent excessively.

Furthermore, the sheet holder 36 rotates so as to reduce the bending angle of the purge sheet 21 in the boundary area between the contact area and the non-contact area between the purge sheet 21 and the sheet holder 36 when the purge sheet 21 is in the printing position. This reduces the bending angle of the purge sheet 21 in the boundary area between the contact areas and the non-contact areas between the purge sheet 21 and the sheet holder 36, and hence reduces the tension generated in the purge sheet 21.

In addition, such a simple configuration is used that the abutting member 31*a* of the carriage frame 31 abuts against the displacement arm 51 when the carriage 22 travels. However, this allows the located position of the tension roller 50 to be displaced securely.

Furthermore, such a simple control is used that the direction of rotation of the maintenance drive motor 65 is switched so that the direction of rotation of the maintenance drive gear 66 is changed. This realizes the draw-out and the roll-up of the purge sheet 21.

Furthermore, the carriage 22 moves the purge sheet 21 at a speed slower than which the sheet roll-up shaft 25 rolls up the sheet. This ensures a tension to be imparted to the purge sheet 21. This prevents slack in the purge sheet 21, and hence ensures the transport of the ink received on the sheet front surface.

In addition, a torque is transmitted to the sheet roll-up shaft 25 via the torque transmission mechanism 60 which transmits the torque within the range of the frictional force between the input plate 61 and the output plate 62. This allows a simple configuration to prevent the occurrence of an excessive tension in the purge sheet 21 during the roll-up of the purge sheet 21.

Furthermore, when the maintenance drive gear 66 revolves in the CW direction, the torque of the maintenance drive gear 66 is not transmitted to the roll-up gear 64 so that the sheet roll-up shaft 25 can rotate freely with a predetermined frictional resistance. Thus, the carriage 22 can draw out the purge sheet 21 easily. At the same time, when the carriage 22 draws out the purge sheet 21, no slack occurs in the purge sheet 21 in the roll-up portion of the sheet roll-up shaft 25.

Furthermore, in the maintenance drive mechanism 28, the planet gear 70 revolves so as to switch whether the planet gear 70 engages with the roll-up gear 64 or not. This allows a simple configuration to switch the transmission or non-transmission of the torque to the roll-up gear.

In addition, the carriage 22 is provided with the wiper 45 and the thin plates 40. This allows the traveling of the purge sheet 21 to serve simultaneously as the removal of the ink adhered to the ink discharging surface 4*a*. This simplifies the structure of the ink jet printer 101.

Furthermore, the roller portion of the tension roller 50 abuts against the purge sheet 21. This reduces the frictional force imparted to the purge sheet 21, and hence reduces damage to the purge sheet 21.

Second Embodiment

Next, a second embodiment of the invention is described below with reference to the drawings. An ink jet printer of the second embodiment is provided with purge sheet support units (moving mechanism) described later. Except for this point, the configuration is substantially the same as that of the ink jet printer 101 according to the first embodiment. Thus, in the drawings and the description concerning the second embodiment, members substantially like those of the first embodiment are designated by like numerals. Hence, their description is omitted.

Figure 13:
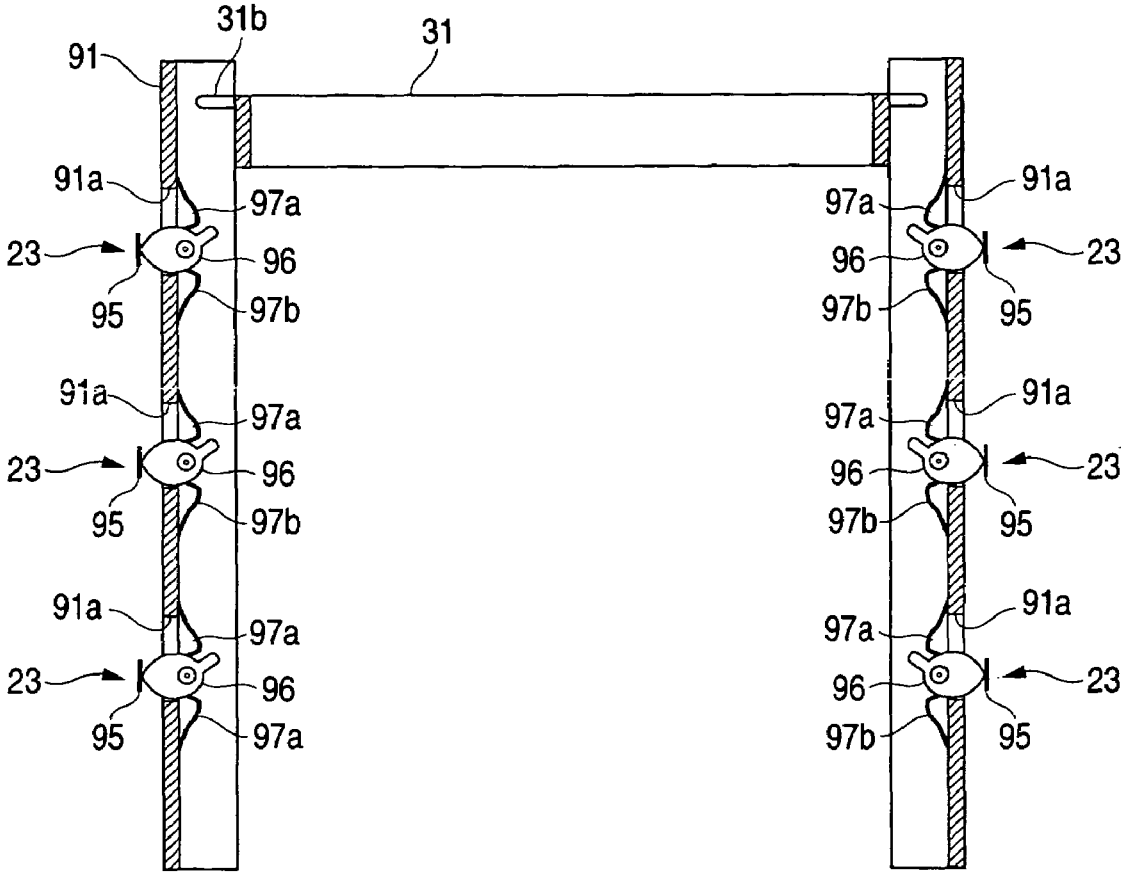
FIG. 13 is a sectional view showing the arranged positions of purge sheet support units according to a second embodiment.
Figure 14A:
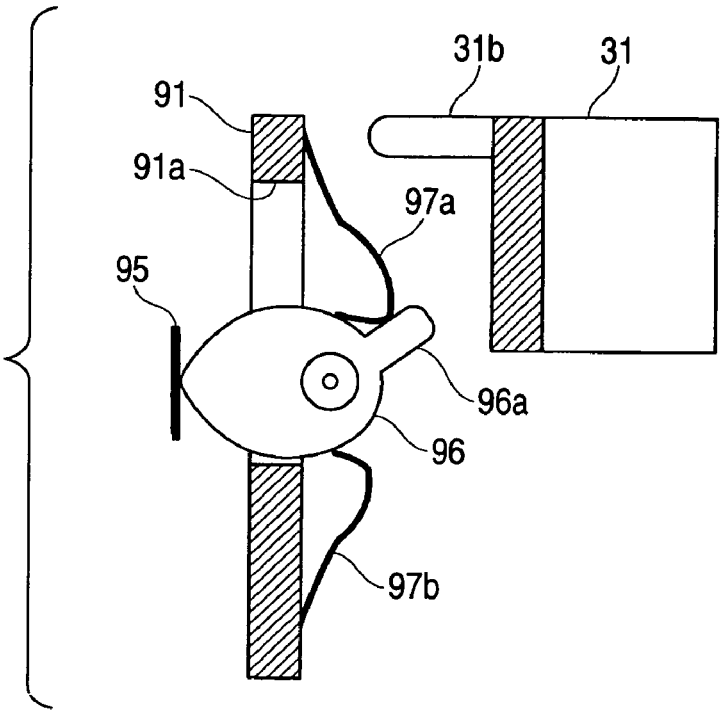
FIGS. 14A and 14B are enlarged views of a purge sheet support unit shown in FIG. 13.
Figure 14B:
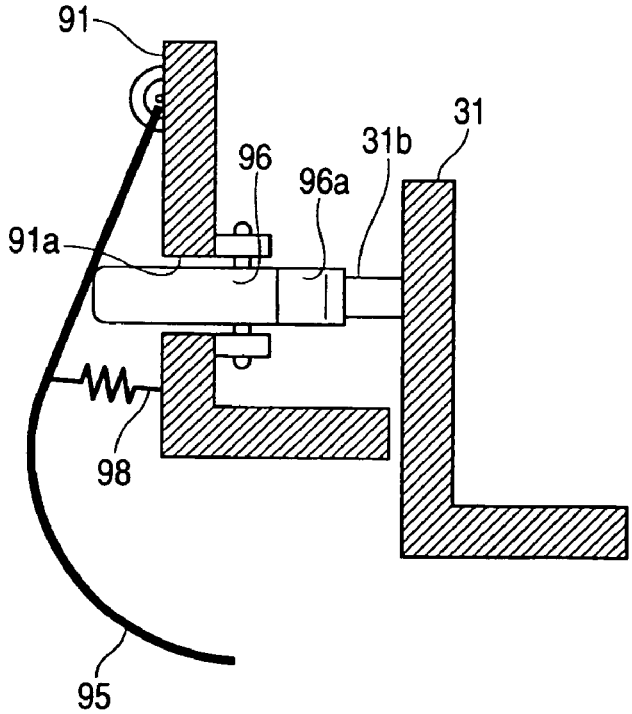
Figure 15A:
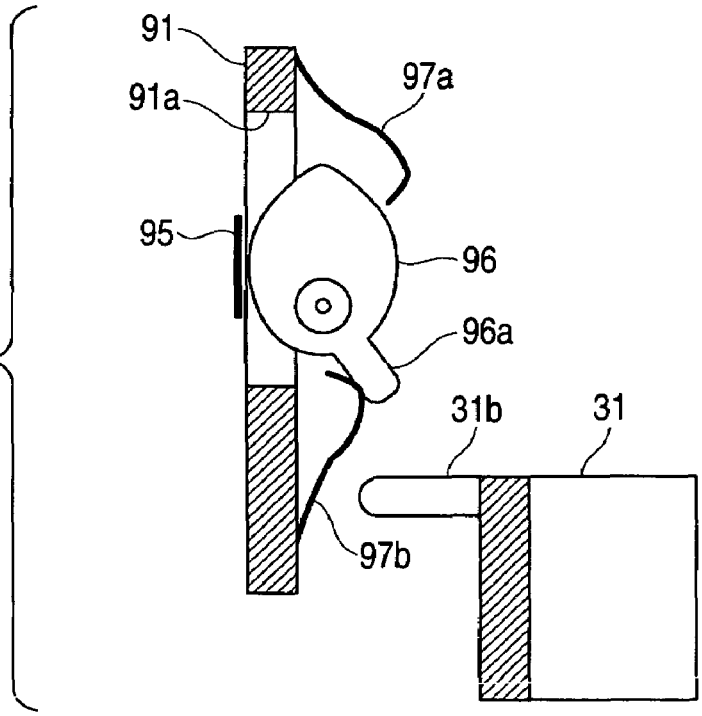
FIGS. 15A and 15B are enlarged views of a purge sheet support unit shown in FIG. 13.
Figure 15B:
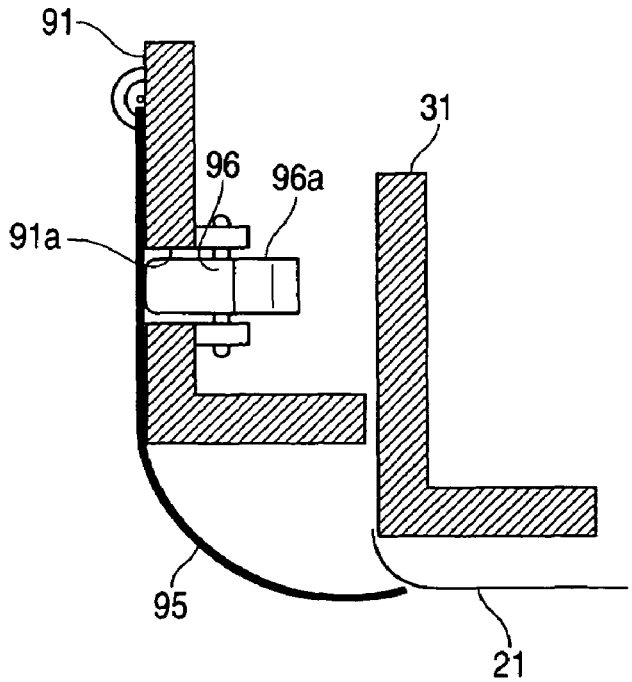

The purge sheet support unit is described below with reference to FIGS. 13, 14A, 14B, 15A, and 15B. FIG. 13 is a sectional view taken along line XIII-XIII in FIG. 1. For simplicity of description of the upper surface of the ink jet printer, the purge sheet support units 23, the main frame 91, and the carriage frame 31 are shown solely. The upper side of the figure corresponds to the main body right side. The lower side of the figure corresponds to the main body left side. FIGS. 14A and 14B are enlarged views of a purge sheet support unit 23 when the carriage 22 is located in the accommodating position. FIG. 14A is a view of the purge sheet support unit 23 viewed from the upper surface. FIG. 14B is a view of the purge sheet support unit 23 viewed from the main body left side. FIGS. 15A and 15B are enlarged views of the purge sheet support unit 23 when the carriage 22 is located in the draw-out position. FIG. 15A is a view of the purge sheet support unit 23 viewed from the upper surface. FIG. 15B is a view of the purge sheet support unit 23 viewed from the main body left side.

The purge sheet support units 23 serve to cause the cross section in the width direction of the purge sheet 21 located in a position opposing the ink discharging surface 4*a* to be concave toward the ink discharging surface 4*a*. As shown in FIG. 13, three purge sheet support units 23 are arranged in each of the main body front side and the main body rear side of the main frame 91 along the running direction of the carriage 22. Each purge sheet support unit 23 includes a supporting member 95, a supporting member cam 96, and flat springs 97*a* and 97*b*. The supporting member 95 supports the purge sheet 21 from the sheet back surface. Furthermore, the supporting member is a plate member 95 one end portion of which is rotatably supported outside the side wall of the main frame 91 and the opposite end portion of which is an open end and extends downward. A bent portion 95*a* which curves toward the carriage frame 31 is formed in the open end area of the supporting member 95. The supporting member 95 is biased by the spring 98 in a direction rotating toward the inside of the main frame 91 (see FIG. 14B and FIG. 15B).

The supporting member cam 96 is a cam for controlling the rotation position of the supporting member 95. Furthermore, the supporting member cam is a plate member in which a cam curve is formed in its periphery so that the shape of the plane is approximately elliptical. The supporting member cam 96 is arranged so that the plane goes through a hole 91*a* formed in the side wall of the main frame 91. Furthermore, the supporting member cam is supported in a horizontally rotatable manner. The supporting member 95 biased by the spring 98 abuts against the supporting member cam 96 side surface located outside the side wall of the main frame 91. Then, when the supporting member cam 96 rotates, the rotation position of the supporting member 95 displaces so as to follow the cam curve formed in the periphery of the supporting member cam 96. A protruding member 96*a* protruding perpendicularly is formed in the side surface of the supporting member cam 96. The flat springs 97*a* and 97*b* restrict the operation range of the protruding member 96*a* of the supporting member cam 96. In the inside of the side wall of the main frame 91, the flat spring 97*a* is arranged on the main body right side of the supporting member cam 96, while the flat spring 97*b* is arranged on the main body left side.

At each end of the longitudinal direction of the carriage frame 31, an interference member 31*b* is formed for interfering with the protruding member 96*a* of the supporting member cam 96 when the carriage 22 travels.

As shown in FIGS. 14A and 14B, when the carriage 22 is located in the accommodating position, the supporting member cam 96 rotates so that the protruding member 96*a* abuts against the flat spring 97*a*. At this time, the supporting member cam 96 is located so that the side surface end portion in the longitudinal direction protrudes to the outside of the main frame 91. The side surface end portion pushes the supporting member 95 further to the outside of the main frame 91. The position of the supporting member 95 at that time is a retracted position where the supporting member 95 does not interfere with the carriage 22.

As shown in FIGS. 15A and 15B, when the carriage 22 travels from the accommodating position side to the draw-out position side, the interference member 31*b* of the carriage frame 31 interferes with the protruding member 96*a* of the supporting member cam 96. Accordingly, the supporting member cam 96 rotates so that the protruding member 96*a* abuts against the flat spring 97*b*. At this time, the supporting member cam 96 is located so that the transverse direction edge portion protrudes to the outside of the main frame 91. Then, the supporting member 95 is located so as to follow the transverse direction edge portion and thereby contact closely to the side wall of the main frame 91. The position of the supporting member 95 at that time is a supporting position where the bent portion of the purge sheet 21 is supported from the sheet back surface in such a manner that the cross section in the width direction of the purge sheet 21 is drawn out by the carriage 22 and thereby located in a position opposing the ink discharging surface 4*a* to be concave toward the ink discharging surface 4*a*. That is, in the course that the carriage 22 travels from the accommodating position side to the draw-out position side, the interference member 31*b* interferes with the protruding members 96*a* sequentially starting at the protruding member nearest to the carriage 22. As a result, the supporting members 95 displace from the retracted position to the supporting position.

According to the second embodiment described above, the supporting member 95 supports the purge sheet 21 so that the cross section in the width direction of the purge sheet 21 located in a position opposing the ink discharging surface 4*a* becomes concave toward the ink discharging surface 4*a*. Thus, ink on the sheet front surface securely moves to the center of the purge sheet 21 along the traveling direction of the carriage 22.

Furthermore, the supporting member 95 is movable from the supporting position to the retracted position. This prevents the supporting member 95 from interfering with the sheet and the carriage 22.

Furthermore, in the course that the carriage 22 travels from the accommodating position side to the draw-out position side, the supporting members 95 displace from the retracted position to the supporting position sequentially starting at the supporting member nearest to the carriage 22. Thus, even during the transport of ink discharged in a purge operation, ink on the sheet front surface of the purge sheet 21 securely moves to the center of the purge sheet 21 along the traveling direction of the carriage 22.

Preferred embodiments of the invention have been described above. However, the invention is not limited to the above-mentioned embodiments, and various design changes can be made within the scope described in the claims. For example, in the embodiments, the purge sheet 21 had flexibility. However, the present invention is not limited to this configuration. The purge sheet need not have flexibility, and may have a large number of folded portions.

In the first embodiment, when the purge sheet 21 is located in a position opposing the ink discharging surface 4*a*, both edges of the width direction are bent toward one side so that the cross section in the width direction of the purge sheet 21 is concave toward the ink discharging surface 4*a*. However, the cross sectional shape is not limited specifically, as long as the ink can move to the center. For example, the cross section in the width direction of the purge sheet may be a V shape toward the ink discharging surface 4*a*. Alternatively, in case that the sheet front surface is further provided with a member for moving the ink to the center, the cross section in the width direction of the purge sheet may be flat.

In the first embodiment, the cross section in the width direction of the purge sheet 21 became concave toward the ink discharging surface 4*a* owing to its own internal stress. However, the cross section may have another shape owing to its own internal stress. Alternatively, such an internal stress may be absent.

Furthermore, in the first embodiment, the blades 26*a*-26*c* have been provided for removing or guiding the ink on the purge sheet 21. However, the two ink guiding blades 26*a* alone or alternatively the ink scraping blade 26*b* alone may be provided. Alternatively, all of these may be omitted.

In the first embodiment, the comb unit 33 is provided with the restriction member 43. However, the restriction member 43 may be omitted. Alternatively, the comb unit 33 itself may be omitted.

In the first embodiment, the purge sheet 21 is fixed to a side surface and both end surfaces of the sheet holder 36, while the sheet holder 36 is supported rotatably. However, the purge sheet 21 may be fixed solely to the bottom surface of the sheet holder 36. Furthermore, the sheet holder may be supported in an unrotatable manner.

In the first embodiment, water repellent finishing is applied to the sheet front surface and the sheet back surface of the purge sheet 21. However, the water repellent finishing may be applied solely to the sheet front surface of the purge sheet 21, or solely to the sheet back surface. Alternatively, water repellent finishing may be omitted.

In the first embodiment, the plane of the purge sheet 21 is inclined downward toward the sheet roll-up shaft 25. However, the inclination may be at another angle. In this case, the disposed ink tank is arranged preferably in a place directed by the inclination.

In the second embodiment, the supporting member 95 has supported the bent portion of the purge sheet 21. However, the edge portion of the purge sheet 21 may be supported. Alternatively, the entirety of the purge sheet 21 may be supported.

In the second embodiment, the purge sheet supporting member 23 is capable of being located in the supporting position and the retracted position. However, the position of the purge sheet supporting member may be fixed.

In the second embodiment, in the course that the purge sheet 21 moves from the purge position to the accommodating position, the purge sheet supporting members 23 move from the supporting position to the retracted position sequentially starting at the purge sheet supporting member nearest to the carriage 22. However, all of the purge sheet supporting members 23 may simultaneously move from the supporting position to the retracted position.

In the first and the second embodiments, when the purge sheet 21 is located in a position opposing the ink discharging surface 4*a*, both edges in the width direction are bent in one direction so that the cross section in the width direction of the purge sheet 21 became concave toward the ink discharging surface 4*a*. However, the cross section in the width direction of the purge sheet may have a V shape toward the ink discharging surface 4*a*, or may have a flat shape.

In the embodiments, the purge sheet 21 is fixed to a side surface and both end surfaces of the sheet holder 36, while the sheet holder 36 is supported rotatably. However, the purge sheet 21 may be fixed solely to the bottom surface of the sheet holder 36. Furthermore, the sheet holder may be supported in an unrotatable manner.

In the embodiments described above, the direction of rotation of the maintenance drive motor 65 is switched so that the direction of rotation of the maintenance drive gear 66 is changed. Two intermediate gears each for transmitting one of the torques in mutually different directions may be provided so that the direction of rotation may be switched by engaging these intermediate gears selectively.

In the embodiments described above, the carriage 22 has moved the purge sheet 21 at a speed slower than that the sheet roll-up shaft 25 rolls up the sheet. However, the carriage 22 may move the purge sheet 21 at the same speed at which the sheet roll-up shaft 25 rolls up the sheet. Alternatively, the carriage 22 need not actively travel.

In the embodiments described above, a torque is transmitted to the sheet roll-up shaft 25 via the torque transmission mechanism 60 which transmits the torque within the range of the frictional force between the input plate 61 and the output plate 62. However, the torque may be transmitted with another configuration. Alternatively, a torque transmission mechanism 60 may be omitted.

The carriage 22 is provided with the wiper 45 and thin plates 40. However, the wiper 45 and thin plates 40 may be omitted.

The roller portion of the tension roller 50 is abutted against the purge sheet 21. However, a member other than the roller, for example, a member having an R shape, may abut against the purge sheet 21.

As described above with reference to the embodiments, according to a first aspect of the invention, there is provided a maintenance mechanism for an ink jet recording apparatus including: a carriage capable of performing a reciprocating motion along a line parallel to an ink discharging surface of an ink jet head; and a sheet attached to the carriage and capable of being located, depending on the position of the carriage, in an ink acceptance position where at least a part thereof goes under the ink jet head and opposes the ink discharging surface and in a recording permission position where an entirety thereof does not oppose the ink discharging surface; wherein when being in the ink acceptance position, the sheet can be in a shape which allows ink discharged from the ink jet head and adhered to the sheet to move, owing to gravity, toward a center of the sheet with respect to a sheet width direction perpendicular to a traveling direction of the carriage.

According to a second aspect of the invention, there is provided an ink jet recording apparatus including: an ink jet head provided with an ink discharging surface in which a plurality of nozzles for discharging ink onto a print medium are formed; a carriage capable of performing reciprocating movement along a line parallel to the ink discharging surface; a sheet attached to the carriage and capable of being located, depending on the position of the carriage, in an ink acceptance position where at least a part thereof goes under the ink jet head and opposes the ink discharging surface and in a recording permission position where an entirety thereof does not oppose the ink discharging surface; carriage controller for issuing an instruction for moving the carriage so that the sheet moves between the ink acceptance position and the recording permission position; discharge controller for providing an ink discharge signal to the ink jet head; and a deformation mechanism for deforming the sheet so that when the sheet is in the ink acceptance position, ink discharged from the ink jet head and located on the sheet moves, owing to gravity, toward a center of the sheet with respect to a direction perpendicular to a traveling direction of the carriage; wherein after the sheet moves to the ink acceptance position in response to an instruction issued by the carriage controller, the discharge controller provides an ink discharge signal to the ink jet head.

According to the aspects described above, when the sheet is in the ink acceptance position (a position where the sheet can be located when a purge operation or a flushing operation is performed), the ink discharged onto the sheet moves toward the center of the sheet with respect to the direction perpendicular to the traveling direction of the carriage. This causes the ink to hardly leak from the edge portion of the sheet. Furthermore, this prevents the necessity of sheet changing, and hence reduces the running cost of printing.

According to the aspects described above, the sheet preferably has flexibility. Accordingly, the occupancy area of the sheet within the level surface (a plane approximately in parallel to the ink discharging surface) is reduced when the sheet is in the recording permission position and permits size reduction in the apparatus.

According to the aspects described above, when the sheet is in the ink acceptance position, a cross section of the sheet is preferably concave so that the surface not opposing the ink jet head protrudes. When the sheet is deformed like this, ink adhered to the sheet easily moves toward the center in the width direction of the sheet.

According to the aspects described above, when the sheet is in the ink acceptance position, both edges of the sheet in an area opposing the ink discharging surface are more preferably bent toward the ink discharging surface. According to this configuration, ink adhered to the sheet efficiently moves to the center of the sheet in the width direction of the sheet.

According to the aspects described above, when the sheet is in the ink acceptance position, the cross section of the sheet preferably becomes concave owing to a self internal stress. This allows a much simpler configuration to cause ink adhered to the sheet to move easily toward the center in the width direction of the sheet.

In the aspects described above, when the sheet is located in a position opposing the ink discharging surface, a supporting member is preferably arranged for supporting the sheet in such a manner that the sheet becomes concave on the surface opposing the the ink jet head. According to this configuration, the sheet is easily maintained in a state deformed in a concave shape. This ensures ink adhered to the sheet to move toward the center in the width direction of the sheet.

In this case, more preferably provided is a moving mechanism for moving the supporting member from a position capable of supporting the sheet to a position not supporting the sheet, by the time that the sheet moves from the ink acceptance position to the recording permission position. This prevents the supporting member from interfering with the print medium and the carriage.

Further in this case, it is much more preferable that a plurality of the supporting members are arranged along the traveling direction of the carriage, and that in the course that the sheet moves from the ink acceptance position to the recording permission position, the moving mechanism causes the supporting members to sequentially move from the position capable of supporting the sheet to the position not supporting the sheet, starting at the supporting member nearest to the carriage. According to this configuration, even during the moving of the sheet, ink adhered to the sheet securely moves toward the center in the width direction of the sheet.

In the aspects described above, the carriage is preferably provided with a wiper for removing ink adhered to the ink discharging surface when the sheet moves from the ink acceptance position to the recording permission position. According to this configuration, ink adhered to the ink discharging surface is removed using the mechanism for moving the sheet (the mechanism for moving the carriage). This simplifies the structure of the maintenance mechanism.

In the aspects described above, it is preferable that the carriage is provided with an ink receiving member which has a plurality of protrusions so that ink adhered to the ink discharging surface is contacted by the protrusions and thereby received between the protrusions, and that the ink receiving member is arranged downstream the wiper with respect to the traveling direction of the carriage of the case that the sheet moves from the ink acceptance position to the recording permission position. According to this configuration, the ink receiving member removes a majority of ink adhered to the ink discharging surface. After that, the wiper removes the remaining ink. This allows to efficiently remove the ink adhered to the ink discharging surface.

In the aspects described above, more preferably provided is a restriction member protruding in a position below a lower end of the ink receiving member so as to prevent the protrusions from contacting with the sheet opposing a bottom surface of the carriage. According to this configuration, a gap is secured between the ink receiving member and the sheet. This allows the received ink to fall onto the sheet efficiently by gravity.

In the aspects described above, it is preferable that the carriage further includes a fixing member to which a leading edge portion of the sheet in the traveling direction is fixed, and that the fixing member is rotatable relative to a main body of the carriage. This allows to reduce a stress generated in the sheet when the carriage travels.

In the aspects described above, it is preferable that the fixing member extends in the sheet width direction and is shorter than the width of the sheet, and that the leading edge portion of the sheet is fixed to the bottom surface and both end surfaces of the fixing member. According to this configuration, the cross section of the sheet easily becomes concave. Thus, ink adhered to the sheet easily moves to the center of the sheet in the width direction of the sheet.

In the aspects described above, water repellent finish is preferably applied to the ink-jet-head-opposing surface of the sheet. According to this configuration, ink adhered to the sheet efficiently moves toward the center in the width direction of the sheet.

In the aspects described above, preferably provided further is an ink guiding member for guiding ink discharged onto the sheet, toward the center of the sheet with respect to the sheet width direction when the sheet moves from the ink acceptance position to the recording permission position. According to this configuration, when the sheet moves, ink adhered to the sheet more securely moves toward the center in the width direction of the sheet.

In the aspects described above, it is preferable that provided further are: an ink scraping member for scraping ink discharged onto the sheet, when the sheet moves from the ink acceptance position to the recording permission position; and a disposed ink tank for storing the ink discharged onto the sheet; and that the disposed ink tank is arranged in a position allowing the ink scraped by the ink scraping member to be accepted. According to this configuration, ink on the sheet is efficiently ejected into the disposed ink tank.

In the aspects described above, preferably provided further is a sheet roll-up mechanism which is arranged below the ink jet head and which rolls up the sheet when the sheet moves from the ink acceptance position to the recording permission position. According to this configuration, the sheet plane is inclined downward toward the sheet roll-up mechanism. Thus, ink adhered to the sheet efficiently moves toward the sheet roll-up mechanism. Furthermore, the sheet is accommodated in a rolled-up state so that the necessary space is reduced.

In the aspects described above, when the sheet is in the ink acceptance position, the plane of the sheet is preferably inclined so that ink on the sheet moves toward the disposed ink tank. According to this configuration, ink on the sheet is ejected more efficiently.

In the aspects described above, it is preferable that provided further is a conveyance mechanism for conveying a print medium onto which ink discharged from the ink jet head impacts, and that when the conveyance mechanism is jammed with a print medium, the sheet moves to the ink acceptance position in response to an instruction issued by the carriage controller. This prevents the ink discharging surface from contacting with foreign materials such as a user's hands during the work of removing a print medium when print medium jamming occurs. Thus, the ink discharging surface is protected.

In this case, more preferably provided further is a cleaning plate for removing ink adhered to the opposite side of the ink-receiving surface of the sheet, when the sheet moves. This prevents a user's hands from being blotted during a work carried out when print medium jamming or the like occurs.

Further in this case, it is much more preferable that water repellent finish is applied to the opposite side of the ink-receiving surface of the sheet. According to this configuration, ink adhered to the opposite side of the ink-receiving surface of the sheet is removed efficiently.

According to a third aspect of the invention, there is provided an ink jet recording apparatus includind: an ink jet head a bottom surface of which is an ink discharging surface; a print medium conveyance mechanism provided under the ink jet head and conveying a print medium; a sheet for accepting ink discharged from the ink discharging surface; sheet accommodating unit provided below the print medium conveyance mechanism and accommodating the sheet; a carriage to which an edge portion of the sheet is attached and which travels a space between the ink jet head and-the print medium conveyance mechanism in a direction crossing from one side toward another side and thereby draws out the sheet having been located in a recording permission position into an ink acceptance position; a sheet abutting member provided in the one side and abutting against the sheet; and displacing unit for positioning the sheet abutting member into a first position for imparting a predetermined tension to the sheet when the carriage is positioned on the other side across the space, and positioning the sheet abutting member into a second position below the first position when the carriage is positioned on the one side.

According to the third aspect, when the sheet is moved from the ink acceptance position to the recording permission position, the sheet abutting member displaces to the second position so as to incline the sheet steeply. This allows ink on the sheet to flow efficiently, and thereby prevents the ink from easily stagnating on the sheet.

In the third aspect, the first position is preferably a position higher than a print medium conveyance surface of the print medium conveyance mechanism on the one side and prevents the sheet located in the ink acceptance position from interfering with the print medium conveyance mechanism.

In the third aspect, it is preferable that a position of the sheet abutting member located in the first position overlaps with a stop position of the carriage on the one side, while a position of the sheet abutting member located in the second position does not overlap with the stop position. This prevents the carriage from interfering with the sheet abutting member when the sheet is in the recording permission position and permits the reduction of the dimension of the ink jet head recording apparatus in the traveling direction of the carriage.

In the third aspect, it is preferable that the edge portion of the sheet is fixed to a bottom surface of the carriage and to a side surface thereof perpendicular to traveling directions of the carriage, and that a distance between the second position where the sheet abutting member is positioned when the sheet is in the recording permission position and a fixed position of the sheet relative to the carriage is longer than a distance between the first position where the sheet abutting member is positioned when the sheet is in the ink acceptance position and the fixed position of the sheet relative to the carriage when the sheet is in the recording permission position. This reduces a tension generated in a bending area of the sheet in the vicinity of the carriage when the sheet is located in the recording permission position. This prevents the bending portion of the sheet from being bent excessively.

In the third aspect, it is preferable that the sheet is attached to a sheet holder attached rotatably to the carriage, and that in a process that the sheet travels from the ink acceptance position to the recording permission position, the sheet holder rotates so as to reduce a sheet bending angle in a boundary portion between a contact area and a non-contact area between the sheet and the sheet holder when the sheet is in the recording permission position, in comparison with a case that the sheet holder does not rotate. This reduces the sheet bending angle in the boundary area between the contact area and the non-contact area between the sheet and the sheet holder, and hence reduces a tension generated in the sheet.

In the third aspect, it is preferable that the displacing unit includes: an abutting member fixed to the carriage; and a displacing member for abutting against the abutting member so as to be displaced in a process that the carriage travels from the other side to the one side; whereby the sheet abutting member is displaced in response to the displacement of the displacing member. This allows a simple configuration to ensure the displacement of the sheet abutting member.

In the third aspect, it is preferable that the apparatus further includes: a drive gear; a carriage gear to which a torque is transmitted from the drive gear when the drive gear rotates in a first direction and which thereby moves the carriage from the one side to the other side so as to move the sheet from the recording permission position to the ink acceptance position; and a roll-up gear to which a torque is transmitted from the drive gear when the drive gear revolves in a second direction opposite the first direction and which thereby rotates a sheet roll-up shaft of the sheet accommodating unit in such a direction that the sheet is rolled up by the sheet roll-up shaft. By virtue of this, the draw-out and the roll-up of the sheet can be performed by such simple control that the direction of rotation is changed in the drive gear.

In the third aspect, it is preferable that when the drive gear revolves in the second direction, a torque is transmitted from the drive gear so that the carriage gear moves the carriage from the other side to the one side so as to move the sheet from the ink acceptance position to the recording permission position at a speed slower than that the sheet roll-up shaft rolls up the sheet. By virtue of this, a tension is securely imparted to the sheet when the sheet travels from the ink acceptance position to the recording permission position. This prevents slack in the sheet, and hence ensures the transport of the received ink.

In the third aspect, it is preferable that the apparatus further includes a torque transmission mechanism which transmits a torque from the roll-up gear to the sheet roll-up shaft when a tension generated on the sheet is smaller than a predetermined value, and which does not transmit the torque from the roll-up gear to the sheet roll-up shaft when the tension generated on the sheet is equal to or greater than the predetermined value. This prevents the occurrence of an excessive tension in the sheet.

In the third aspect, it is more preferable that the torque transmission mechanism includes: an input plate to which a torque is transmitted from the roll-up gear; an output plate for transmitting a torque to the sheet roll-up shaft; and a bias spring for biasing a plane section of the output plate toward a plane section of the input plate; whereby when the tension generated on the sheet is smaller than the predetermined value, the output plate biased by the bias spring revolves together with the input plate so that the torque transmitted to the input plate is transmitted to the output plate, while when the tension generated on the sheet is equal to or greater than the predetermined value, the output plate biased by the bias spring slips relative to the input plate so that the torque transmitted to the input plate is not transmitted to the output plate. This allows a simple configuration to prevent the occurrence of an excessive tension in the sheet.

In the third aspect, it is preferable that when the drive gear revolves in the first direction, the torque of the drive gear is not transmitted to the roll-up gear. This allows the carriage to draw out the sheet easily.

In the third aspect, it is preferable that when the torque is not transmitted to the roll-up gear, the sheet roll-up shaft is in a state permitting free revolution with a predetermined frictional resistance. This prevents slack in the rolled-up portion of the sheet when the carriage draws out the sheet.

In the third aspect, it is preferable that the apparatus further includes: a sun gear for transmitting a torque from the drive gear to the roll-up gear; and a planet gear for engaging with the sun gear and thereby revolving around the sun gear; and that when the drive gear revolves in the first direction, the sun gear moves the planet gear to such a position that no torque is transmitted to the sheet roll-up shaft, while when-the drive gear revolves in the second direction, the sun gear moves the planet gear to such a position that a torque is transmitted to the sheet roll-up shaft. This allows a simple configuration to switch the transmission or non-transmission of the torque to the roll-up gear.

In the third aspect, the carriage is preferably provided with a wiper for removing ink adhered to the ink discharging surface, when the carriage travels from the other side to the one side. By virtue of this, the traveling of the sheet serves simultaneously as the removal of the ink adhered to the ink discharging surface. This simplifies the structure of the ink jet recording apparatus.

In the third aspect, the sheet abutting member is preferably composed of a roller. This reduces a frictional force imparted to the sheet, and hence reduces damage to the sheet.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments are chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A maintenance mechanism for an ink jet recording apparatus having an ink jet head, the maintenance mechanism comprising:

a carriage that performs reciprocating movement along a line parallel to an ink discharging surface of the ink jet head; and a purge sheet attached to the carriage and arranged to be in either of an ink acceptance position and a recording permission position depending on a position of the carriage, the ink acceptance position in which at least a part of the purge sheet is disposed under the ink jet head and opposes the ink discharging surface, and the recording permission position in which an entirety of the purge sheet is removed from the ink discharging surface, wherein being in the ink acceptance position, the purge sheet is formed of a shape that allows ink discharged from the ink jet head and adhered to the purge sheet to move, owing to gravity, toward a center of the purge sheet with respect to a purge sheet width direction perpendicular to a traveling direction of the carriage, the traveling direction in which the carriage performs the reciprocating movement.

2. The maintenance mechanism according to claim 1, wherein the purge sheet has flexibility.

3. The maintenance mechanism according to claim 2, wherein when the purge sheet is in the ink acceptance position, the purge sheet forms a concave shape in which a cross section of the purge sheet along the purge sheet width direction is concave so that a surface thereof not opposing the ink jet head protrudes.

4. The maintenance mechanism according to claim 3, wherein when the purge sheet is in the ink acceptance position, both edges of the purge sheet width direction in an area opposing the ink discharging surface are bent toward the ink discharging surface.

5. The maintenance mechanism according to claim 3, wherein when the purge sheet is in the ink acceptance position, the cross section of the purge sheet becomes concave owing to an internal stress of the purge sheet.

6. The maintenance mechanism according to claim 3, further comprising a supporting member that supports the purge sheet to form the concave shape when the purge sheet is in the ink acceptance position.

7. The maintenance mechanism according to claim 6, further comprising a moving mechanism that moves the supporting member from a position for supporting the purge sheet to a position retracted from the purge sheet while the purge sheet is moved from the ink acceptance position to the recording permission position.

8. The maintenance mechanism according to claim 7, wherein a plurality of the supporting members are arranged along the traveling direction of the carriage, and wherein in a course that the purge sheet moves from the ink acceptance position to the recording permission position, the moving mechanism causes the supporting members to sequentially move from the position for supporting the purge sheet to the position retracted from the purge sheet, starting at the supporting member being nearest to the carriage.

9. The maintenance mechanism according to claim 2, further comprising a sheet roll-up mechanism arranged below the ink jet head and rolls up the purge sheet when the purge sheet moves from the ink acceptance position to the recording permission position.

10. The maintenance mechanism according to claim 9, further comprising:

an ink scraping member that scrapes ink discharged onto the purge sheet, when the purge sheet moves from the ink acceptance position to the recording permission position; and a disposed ink tank that stores the ink discharged onto the purge sheet, wherein the disposed ink tank is arranged in a position allowing the ink scraped by the ink scraping member to be accepted.

11. The maintenance mechanism according to claim 10, wherein when the purge sheet is in the ink acceptance position, the purge sheet is inclined to move the ink on the purge sheet toward the disposed ink tank.

12. The maintenance mechanism according to claim 1, wherein the carriage is provided with a wiper that removes ink adhered to the ink discharging surface when the purge sheet moves from the ink acceptance position to the recording permission position.

13. The maintenance mechanism according to claim 12, wherein the carriage is provided with an ink receiving member having a plurality of protrusions that contacts with the ink adhered to the ink discharging surface and receives the ink between the protrusions, and wherein the ink receiving member is arranged downstream from the wiper with respect to the traveling direction of the carriage in the case where the purge sheet moves from the ink acceptance position to the recording permission position.

14. The maintenance mechanism according to claim 13, further comprising a restriction member that protrudes in a position below a lower end of the ink receiving member to prevent the protrusions from contacting with the purge sheet opposing a bottom surface of the carriage.

15. The maintenance mechanism according to claim 1, wherein the carriage further includes: a main body; and a fixing member to which a leading edge portion of the purge sheet in the traveling direction is fixed, and wherein the fixing member is rotatable relative to the main body.

16. The maintenance mechanism according to claim 15, wherein the fixing member extends in the purge sheet width direction and is shorter than the width of the purge sheet, and wherein the leading edge portion of the sheet is fixed to the bottom surface and both end surfaces of the fixing member.

17. The maintenance mechanism according to claim 1, wherein a water repellent finish is applied to a surface of the purge sheet, the surface that opposes to the ink jet head.

18. The maintenance mechanism according to claim 1, further comprising an ink guiding member that guides ink discharged onto the purge sheet, toward the center of the purge sheet when the purge sheet moves from the ink acceptance position to the recording permission position.

19. The maintenance mechanism according to claim 1, further comprising:

an ink scraping member that scrapes ink discharged onto the purge sheet, when the purge sheet moves from the ink acceptance position to the recording permission position; and a disposed ink tank that stores the ink discharged onto the purge sheet, wherein the disposed ink tank is arranged in a position allowing the ink scraped by the ink scraping member to be accepted.

20. An ink jet recording apparatus comprising:

an ink jet head provided with an ink discharging surface in which a plurality of nozzles for discharging ink onto a print medium are formed;

a carriage that performs reciprocating movement along a line parallel to the ink discharging surface;

a purge sheet attached to the carriage and arranged to be in either of an ink acceptance position and a recording permission position depending on a position of the carriage, the ink acceptance position in which at least a part of the purge sheet is disposed under the ink jet head and opposes the ink discharging surface, and the recording permission position in which an entirety of the purge sheet is removed from the ink discharging surface, a carriage controller that controls the carriage to perform the reciprocating movement for moving the purge sheet between the ink acceptance position and the recording permission position;

a discharge controller that controls the ink jet head for discharging the ink; and a deformation mechanism that deforms, when the purge sheet is in the ink acceptance position, the purge sheet into a shape that allows ink discharged from the ink jet head and adhered to the purge sheet to move, owing to gravity, toward a center of the purge sheet with respect to a purge sheet width direction perpendicular to a traveling direction of the carriage, the traveling direction in which the carriage performs the reciprocating movement, wherein the discharge controller controls the ink jet head to discharge ink in a state where the purge sheet is in the ink acceptance position.

21. The ink jet recording apparatus according to claim 20, further comprising a conveyance mechanism that conveys the print medium onto which the ink discharged from the ink jet head impacts, wherein when the conveyance mechanism is jammed with the print medium, the carriage controller controls the carriage to move the purge sheet to the ink acceptance position.

22. The ink jet recording apparatus according to claim 21, further comprising a cleaning member that removes ink adhered to the opposite side of the ink-receiving surface of the purge sheet when the purge sheet is moved between the ink acceptance position and the recording permission position.

23. The ink jet recording apparatus according to claim 21, wherein a water repellent finish is applied to a surface of the purge sheet, the surface that opposes to the ink jet head.

24. An ink jet recording apparatus comprising:

an ink jet head provided with an ink discharging surface in which a plurality of nozzles for discharging ink onto a print medium are formed;

a conveyance mechanism that conveys the print medium and provided below the ink jet head;

a purge sheet that accepts ink discharged from the ink discharging surface;

a sheet accommodating unit provided below the print medium conveyance mechanism and accommodates the purge sheet;

a carriage to which an edge portion of the sheet is attached and travels a space between the ink jet head and the print medium conveyance mechanism in a traveling direction crossing from one side toward another side to draw out the purge sheet from a recording permission position into an ink acceptance position, the ink acceptance position in which at least a part of the purge sheet is disposed under the ink jet head and opposes the ink discharging surface, and the recording permission position in which an entirety of the purge sheet is removed from the ink discharging surface;

a sheet abutting member provided in the one side and abuts against the purge sheet; and a displacing unit that positions the sheet abutting member into a first position for imparting a predetermined tension to the purge sheet when the carriage is positioned on the other side across the space, and positions the sheet abutting member into a second position below the first position when the carriage is positioned on the one side.

25. The ink jet recording apparatus according to claim 24, wherein the first position is configured to be higher than a print medium conveyance surface of the print medium conveyance mechanism on the one side, the print medium conveyance surface on which the print medium is conveyed.

26. The ink jet recording apparatus according to claim 24, wherein a position of the sheet abutting member located in the first position overlaps with a stop position of the carriage on the one side, while a position of the sheet abutting member located in the second position is different from the stop position.

27. The ink jet recording apparatus according to claim 24, wherein the edge portion of the purge sheet is fixed to a bottom surface of the carriage and to a side surface thereof perpendicular to the traveling direction of the carriage, and wherein a distance between the second position where the sheet abutting member is positioned when the purge sheet is in the recording permission position and a fixed position of the purge sheet relative to the carriage is longer than a distance between the first position where the sheet abutting member is positioned when the purge sheet is in the ink acceptance position and the fixed position of the purge sheet relative to the carriage when the purge sheet is in the recording permission position.

28. The ink jet recording apparatus according to claim 27, wherein the purge sheet is attached to a sheet holder attached rotatably to the carriage, and wherein in a process that the purge sheet travels from the ink acceptance position to the recording permission position, the sheet holder rotates so as to reduce a sheet bending angle in a boundary portion between a contact area and a non-contact area between the purge sheet and the sheet holder when the purge sheet is in the recording permission position, in comparison with a case where the sheet holder does not rotate.

29. The ink jet recording apparatus according to claim 24, wherein the displacing unit includes:

an abutting member fixed to the carriage; and a displacing member that abuts against the abutting member so as to be displaced in a process that the carriage travels from the other side to the one side to displace the sheet abutting member in response to the displacement of the displacing member.

30. The ink jet recording apparatus according to claim 24, wherein the sheet accommodating unit includes a sheet roll-up shaft that rolls up the purge sheet, and wherein the ink jet recording apparatus further comprises:

a drive gear;

a carriage gear to which a torque is transmitted from the drive gear when the drive gear revolves in a first direction and which thereby moves the carriage from the one side to the other side so as to move the purge sheet from the recording permission position to the ink acceptance position; and a roll-up gear to which a torque is transmitted from the drive gear when the drive gear revolves in a second direction opposite the first direction and which thereby rotates the sheet roll-up shaft of the sheet accommodating unit to roll up the purge sheet.

31. The ink jet recording apparatus according to claim 30, wherein when the drive gear revolves in the second direction, the torque is transmitted from the drive gear for the carriage gear to move the carriage from the other side to the one side so as to move the purge sheet from the ink acceptance position to the recording permission position at a speed slower than a speed in which the sheet roll-up shaft rolls up the purge sheet.

32. The ink jet recording apparatus according to claim 31, further comprising a torque transmission mechanism that transmits the torque from the roll-up gear to the sheet roll-up shaft when a tension generated on the purge sheet is smaller than a predetermined value, and that transmits no torque from the roll-up gear to the sheet roll-up shaft when the tension generated on the purge sheet is equal to or greater than the predetermined value.

33. The ink jet recording apparatus according to claim 32, wherein the torque transmission mechanism includes:

an input plate to which the torque is transmitted from the roll-up gear;

an output plate that transmits the torque to the sheet roll-up shaft; and a bias spring that biases a plane section of the output plate toward a plane section of the input plate, wherein when the tension generated on the purge sheet is smaller than the predetermined value, the output plate biased by the bias spring revolves together with the input plate to transmit the torque transmitted to the input plate to the output plate, and wherein when the tension generated on the purge sheet is equal to or greater than the predetermined value, the output plate biased by the bias spring slips relative to the input plate to transmit no torque to the output plate.

34. The ink jet recording apparatus according to claim 30, wherein when the drive gear revolves in the first direction, no torque is transmitted from the drive gear to the roll-up gear.

35. The ink jet recording apparatus according to claim 34, wherein when no torque is transmitted from the drive gear to the roll-up gear, the sheet roll-up shaft is in a state permitting free revolution with a predetermined frictional resistance.

36. The ink jet recording apparatus according to claim 30, further comprising:

a sun gear that transmits the torque from the drive gear to the roll-up gear; and a planet gear that engages with the sun gear and revolves around the sun gear, wherein when the drive gear revolves in the first direction, the sun gear moves the planet gear to such a position that no torque is transmitted to the sheet roll-up shaft, and wherein when the drive gear revolves in the second direction, the sun gear moves the planet gear to such a position that the torque is transmitted to the sheet roll-up shaft.

37. The ink jet recording apparatus according to claim 24, wherein the carriage is provided with a wiper that removes ink adhered to the ink discharging surface, when the carriage travels from the other side to the one side.

38. The ink jet recording apparatus according to claim 24, wherein the sheet abutting member includes a roller.

* * * * *